US010760830B2

(12) United States Patent
Vandermeulen et al.

(10) Patent No.: US 10,760,830 B2
(45) Date of Patent: Sep. 1, 2020

(54) DESICCANT AIR CONDITIONING METHODS AND SYSTEMS

(71) Applicant: 7AC Technologies, Inc., Beverly, MA (US)

(72) Inventors: Peter F. Vandermeulen, Newburyport, MA (US); Arthur Laflamme, Rowley, MA (US); Mark Allen, Essex, MA (US); Robert Doody, Gloucester, MA (US); David Pitcher, Beverly, MA (US)

(73) Assignee: 7AC Technologies, Inc., Beverly, MA (US)

( * ) Notice: Subject to any disclaimer, the term of this patent is extended or adjusted under 35 U.S.C. 154(b) by 54 days.

(21) Appl. No.: 15/457,506

(22) Filed: Mar. 13, 2017

(65) Prior Publication Data

US 2017/0184319 A1 Jun. 29, 2017

Related U.S. Application Data

(62) Division of application No. 14/193,781, filed on Feb. 28, 2014, now Pat. No. 9,631,848.
(Continued)

(51) Int. Cl.
*F25B 29/00* (2006.01)
*F24F 3/14* (2006.01)
*F25B 25/00* (2006.01)

(52) U.S. Cl.
CPC ..... *F25B 29/006* (2013.01); *F24F 3/1417* (2013.01); *F24F 2003/1435* (2013.01);
(Continued)

(58) Field of Classification Search
CPC ..... F25B 29/006; F25B 25/005; F25B 2339/047; F24F 3/1417; F24F 2003/1435;
(Continued)

(56) References Cited

U.S. PATENT DOCUMENTS 1,791,086 A 2/1931 Sperr
2,221,787 A 11/1940 Downs et al.
(Continued)

FOREIGN PATENT DOCUMENTS

CN 100366981 C 2/2008
CN 101336358 A 12/2008
(Continued)

OTHER PUBLICATIONS

Lachner, "An Investigation into the Feasibility of the Use of Water as a Refrigerant," International Refrigeration and Air Conditioning Conference, 723:1-9 (2004).
(Continued)

*Primary Examiner* — Ana M Vazquez
(74) *Attorney, Agent, or Firm* — Foley Hoag LLP; Rajesh Vallabh

(57) ABSTRACT

A desiccant air conditioning system for treating an air stream entering a building space, including a conditioner configured to expose the air stream to a liquid desiccant such that the liquid desiccant dehumidifies the air stream in the warm weather operation mode and humidifies the air stream in the cold weather operation mode. The conditioner includes multiple plate structures arranged in a vertical orientation and spaced apart to permit the air stream to flow between the plate structures. Each plate structure includes a passage through which a heat transfer fluid can flow. Each plate structure also has at least one surface across which the liquid desiccant can flow. The system includes a regenerator connected to the conditioner for causing the liquid desiccant to desorb water in the warm weather operation mode and to absorb water in the cold weather operation mode from a return air stream.

17 Claims, 21 Drawing Sheets

Related U.S. Application Data

(60) Provisional application No. 61/771,340, filed on Mar. 1, 2013.

(52) U.S. Cl.
CPC . *F24F 2003/1458* (2013.01); *F24F 2203/021* (2013.01); *F25B 25/005* (2013.01); *F25B 2339/047* (2013.01)

(58) Field of Classification Search
CPC ..... F24F 2003/1458; F24F 2203/021; F24F 11/81; F24F 3/1429; F24F 2203/1008; F24F 2003/144
See application file for complete search history.

(56) References Cited

U.S. PATENT DOCUMENTS 2,235,322 A 3/1941 Martin
2,433,741 A 12/1947 Crawford
2,634,958 A 4/1953 Simpelaar
2,660,159 A 11/1953 Hughes
2,708,915 A 5/1955 Mandelburg
2,939,686 A 6/1960 Wildermuth
2,988,171 A 6/1961 Arnold et al.
3,119,446 A 1/1964 Weiss
3,193,001 A 7/1965 Meckler
3,276,634 A 10/1966 Arnot
3,409,969 A 11/1968 Simons
3,410,581 A 11/1968 Christensen
3,455,338 A 7/1969 Pollit
3,718,181 A 2/1973 Reilly et al.
4,100,331 A 7/1978 Fletcher et al.
4,164,125 A 8/1979 Griffiths
4,176,523 A 12/1979 Rousseau
4,205,529 A 6/1980 Ko
4,209,368 A 6/1980 Coker et al.
4,222,244 A 9/1980 Meckler
4,235,221 A 11/1980 Murphy
4,239,507 A 12/1980 Benoit et al.
4,259,849 A 4/1981 Griffiths
4,324,947 A 4/1982 Dumbeck
4,399,862 A 8/1983 Hile
4,429,545 A 2/1984 Steinberg
4,435,339 A 3/1984 Kragh
4,444,992 A 4/1984 Cox, III
4,583,996 A 4/1986 Sakata et al.
4,607,132 A 8/1986 Jarnagin
4,612,019 A 9/1986 Langhorst
4,649,899 A 3/1987 Moore
4,660,390 A 4/1987 Worthington
4,691,530 A 9/1987 Meckler
4,703,629 A 11/1987 Moore
4,730,600 A 3/1988 Harrigill
4,744,414 A 5/1988 Schon
4,766,952 A 8/1988 Onodera
4,786,301 A 11/1988 Rhodes
4,832,115 A 5/1989 Albers et al.
4,872,578 A 10/1989 Fuerschbach et al.
4,882,907 A 11/1989 Brown, II
4,887,438 A 12/1989 Meckler
4,900,448 A 2/1990 Bonne et al.
4,910,971 A 3/1990 McNab
4,939,906 A 7/1990 Spatz et al.
4,941,324 A 7/1990 Peterson et al.
4,955,205 A 9/1990 Wilkinson
4,971,142 A 11/1990 Mergler
4,976,313 A 12/1990 Dahlgren et al.
4,979,965 A 12/1990 Sannholm
4,984,434 A 1/1991 Peterson et al.
4,987,750 A 1/1991 Meckler
5,005,371 A 4/1991 Yonezawa et al.
5,181,387 A 1/1993 Meckler
5,182,921 A 2/1993 Yan
5,186,903 A 2/1993 Cornwell
5,191,771 A 3/1993 Meckler
5,221,520 A 6/1993 Cornwell
5,351,497 A 10/1994 Lowenstein
5,361,828 A 11/1994 Lee et al.
5,375,429 A 12/1994 Tokizaki et al.
5,448,895 A 9/1995 Coellner et al.
5,462,113 A 10/1995 Wand
5,471,852 A 12/1995 Meckler
5,528,905 A 6/1996 Scarlatti
5,534,186 A 7/1996 Walker et al.
5,582,026 A 12/1996 Barto, Sr.
5,595,690 A 1/1997 Filburn et al.
5,605,628 A 2/1997 Davidson et al.
5,606,865 A 3/1997 Caron
5,638,900 A 6/1997 Lowenstein et al.
5,641,337 A 6/1997 Arrowsmith et al.
5,661,983 A 9/1997 Groten et al.
5,685,152 A 11/1997 Sterling
5,685,485 A 11/1997 Mock et al.
5,797,272 A 8/1998 James
5,816,065 A 10/1998 Maeda
5,832,993 A 11/1998 Ohata et al.
5,860,284 A 1/1999 Goland et al.
5,860,285 A 1/1999 Tulpule
5,928,808 A 7/1999 Eshraghi
5,933,702 A 8/1999 Goswami
5,950,442 A 9/1999 Maeda et al.
6,012,296 A 1/2000 Shah
6,018,954 A 2/2000 Assaf
6,035,657 A 3/2000 Dobak, III et al.
6,083,387 A 7/2000 LeBlanc et al.
6,103,969 A 8/2000 Bussey
6,131,649 A 10/2000 Pearl et al.
6,134,903 A 10/2000 Potnis et al.
6,138,470 A 10/2000 Potnis et al.
6,156,102 A 12/2000 Conrad et al.
6,171,374 B1 1/2001 Barton et al.
6,216,483 B1 4/2001 Potnis et al.
6,216,489 B1 4/2001 Potnis et al.
6,244,062 B1 6/2001 Prado
6,247,604 B1 6/2001 Taskis et al.
6,266,975 B1 7/2001 Assaf
6,417,423 B1 7/2002 Koper et al.
6,442,951 B1 9/2002 Maeda et al.
6,463,750 B2 10/2002 Assaf
6,487,872 B1 12/2002 Forkosh et al.
6,488,900 B1 12/2002 Call et al.
6,497,107 B2 12/2002 Maisotsenko et al.
6,497,749 B2 12/2002 Kesten et al.
6,502,807 B1 1/2003 Assaf et al.
6,514,321 B1 2/2003 Lehto et al.
6,539,731 B2 4/2003 Kesten et al.
6,546,746 B2 4/2003 Forkosh et al.
6,557,365 B2 5/2003 Dinnage et al.
6,660,069 B2 12/2003 Sato et al.
6,684,649 B1 2/2004 Thompson
6,739,142 B2 5/2004 Korin
6,745,826 B2 6/2004 Lowenstein et al.
6,766,817 B2 7/2004 da Silva et al.
6,848,265 B2 2/2005 Lowenstein et al.
6,854,278 B2 2/2005 Maisotsenko et al.
6,854,279 B1 2/2005 Digiovanni et al.
6,918,404 B2 7/2005 Dias da Silva et al.
6,938,434 B1 9/2005 Fair
6,945,065 B2 9/2005 Lee et al.
6,976,365 B2 12/2005 Forkosh et al.
6,986,428 B2 1/2006 Hester et al.
7,066,586 B2 6/2006 Da Silva et al.
RE39,288 E 9/2006 Assaf
7,143,597 B2 12/2006 Hyland et al.
7,191,821 B2 3/2007 Gronwall et al.
7,197,887 B2 4/2007 Maisotsenko et al.
7,228,891 B2 6/2007 Shin et al.
7,258,923 B2 8/2007 van den Bogerd et al.
7,269,966 B2 9/2007 Lowenstein et al.
7,279,215 B2 10/2007 Hester et al.
7,306,650 B2 12/2007 Slayzak et al.
7,337,615 B2 3/2008 Reidy
7,430,878 B2 10/2008 Assaf

(56) References Cited

U.S. PATENT DOCUMENTS 7,758,671 B2 7/2010 Kesten et al.
7,930,896 B2 4/2011 Matsui et al.
7,938,888 B2 5/2011 Assaf
8,141,379 B2 3/2012 Al-Hadhrami et al.
8,337,590 B2 12/2012 Herencia et al.
8,353,175 B2 1/2013 Wohlert
8,496,732 B2 7/2013 Culp et al.
8,499,576 B2 8/2013 Meijer
8,500,960 B2 8/2013 Ehrenberg et al.
8,623,210 B2 1/2014 Manabe et al.
8,641,806 B2 2/2014 Claridge et al.
8,648,209 B1 2/2014 Lastella
8,695,363 B2 4/2014 Tang et al.
8,696,805 B2 4/2014 Chang et al.
8,769,971 B2 7/2014 Kozubal et al.
8,790,454 B2 7/2014 Lee et al.
8,800,308 B2 8/2014 Vandermeulen et al.
8,876,943 B2 11/2014 Gottlieb et al.
8,881,806 B2 11/2014 Xie et al.
8,943,844 B2 2/2015 Forkosh
8,943,850 B2 2/2015 Vandermeulen et al.
8,968,945 B2 3/2015 Fasold et al.
9,000,289 B2 4/2015 Vandermeulen et al.
9,086,223 B2 7/2015 Vandermeulen et al.
9,101,874 B2 8/2015 Vandermeulen
9,101,875 B2 8/2015 Vandermeulen et al.
9,243,810 B2 1/2016 Vandermeulen et al.
9,273,877 B2 3/2016 Vandermeulen et al.
9,308,490 B2 4/2016 Vandermeulen et al.
9,377,207 B2 6/2016 Vandermeulen et al.
9,429,332 B2 8/2016 Vandermeulen et al.
9,470,426 B2 10/2016 Vandermeulen
9,506,697 B2 11/2016 Vandermeulen
9,631,823 B2 4/2017 Vandermeulen et al.
9,631,824 B1 4/2017 Maisey et al.
9,631,848 B2 4/2017 Vandermeulen et al.
9,709,285 B2 7/2017 Vandermeulen
9,709,286 B2 7/2017 Vandermeulen et al.
9,835,340 B2 12/2017 Vandermeulen et al.
10,006,648 B2 6/2018 Vandermeulen et al.
10,024,558 B2 7/2018 Vandermeulen
10,024,601 B2 7/2018 Vandermeulen
10,168,056 B2 1/2019 Vandermeulen et al.
10,323,867 B2 6/2019 Vandermeulen
2001/0008148 A1 7/2001 Ito et al.
2001/0013226 A1 8/2001 Potnis et al.
2001/0015500 A1 8/2001 Shimanuki et al.
2002/0023740 A1 2/2002 Lowenstein et al.
2002/0026797 A1 3/2002 Sundhar
2002/0038552 A1 4/2002 Maisotsenko et al.
2002/0098395 A1 7/2002 Shimanuki et al.
2002/0104439 A1 8/2002 Komkova et al.
2002/0139245 A1 10/2002 Kesten et al.
2002/0139320 A1 10/2002 Shimanuki et al.
2002/0148602 A1 10/2002 Nakamura
2003/0000230 A1 1/2003 Kopko
2003/0029185 A1 2/2003 Kopko
2003/0033821 A1 2/2003 Maisotsenko et al.
2003/0051498 A1 3/2003 Sanford
2003/0106680 A1 6/2003 Serpico et al.
2003/0121271 A1 7/2003 Dinnage et al.
2003/0209017 A1 11/2003 Maisotsenko et al.
2003/0230092 A1 12/2003 Lowenstein et al.
2004/0040697 A1 3/2004 Pierre et al.
2004/0061245 A1 4/2004 Maisotsenko et al.
2004/0101698 A1 5/2004 Yamanaka et al.
2004/0109798 A1 6/2004 Chopard et al.
2004/0112077 A1 6/2004 Forkosh et al.
2004/0118125 A1 6/2004 Potnis et al.
2004/0134212 A1 7/2004 Lee et al.
2004/0168462 A1 9/2004 Assaf
2004/0194944 A1 10/2004 Hendricks et al.
2004/0211207 A1 10/2004 Forkosh et al.
2004/0230092 A1 11/2004 Thierfelder et al.
2004/0231512 A1 11/2004 Slayzak et al.
2004/0261440 A1 12/2004 Forkosh et al.
2005/0095433 A1 5/2005 Bogerd et al.
2005/0106021 A1 5/2005 Bunker et al.
2005/0109052 A1 5/2005 Albers et al.
2005/0133082 A1 6/2005 Konold et al.
2005/0210907 A1 9/2005 Gillan et al.
2005/0217485 A1 10/2005 Olapinski et al.
2005/0218535 A1 10/2005 Maisotsenko et al.
2005/0257551 A1 11/2005 Landry
2006/0042295 A1 3/2006 Assaf
2006/0070728 A1 4/2006 Shin et al.
2006/0124287 A1 6/2006 Reinders
2006/0156750 A1 7/2006 Lowenstein et al.
2006/0156761 A1 7/2006 Mola et al.
2006/0278089 A1 12/2006 Theilow
2007/0169916 A1 7/2007 Wand et al.
2007/0175234 A1 8/2007 Pruitt
2007/0234743 A1 10/2007 Assaf
2008/0127965 A1 6/2008 Burton
2008/0156471 A1 7/2008 Han et al.
2008/0196758 A1 8/2008 McGuire
2008/0203866 A1 8/2008 Chamberlain
2008/0302357 A1 12/2008 DeNault
2008/0314567 A1 12/2008 Noren
2009/0000732 A1 1/2009 Jacobine et al.
2009/0056919 A1 3/2009 Hoffman et al.
2009/0095162 A1 4/2009 Hargis et al.
2009/0126913 A1 5/2009 Lee et al.
2009/0173096 A1 7/2009 Wohlert
2009/0183857 A1 7/2009 Pierce et al.
2009/0200022 A1 8/2009 Bravo et al.
2009/0238685 A1 9/2009 Santa Ana
2010/0000247 A1 1/2010 Bhatti et al.
2010/0012309 A1 1/2010 Uges
2010/0018322 A1 1/2010 Neitzke et al.
2010/0051083 A1 3/2010 Boyk
2010/0077783 A1 4/2010 Bhatti et al.
2010/0084120 A1 4/2010 Yin et al.
2010/0170776 A1 7/2010 Ehrenberg et al.
2010/0319370 A1 12/2010 Kozubal et al.
2011/0073290 A1 3/2011 Chang et al.
2011/0100618 A1 5/2011 Carlson
2011/0101117 A1 5/2011 Miyauchi et al.
2011/0126885 A1 6/2011 Kokotov et al.
2011/0132027 A1 6/2011 Gommed et al.
2012/0052785 A1 3/2012 Nagamatsu et al.
2012/0114527 A1 5/2012 Hoglund et al.
2012/0118148 A1 5/2012 Culp et al.
2012/0118155 A1 5/2012 Claridge et al.
2012/0125020 A1 5/2012 Vandermeulen et al.
2012/0125021 A1 5/2012 Vandermeulen et al.
2012/0125031 A1 5/2012 Vandermeulen et al.
2012/0125581 A1 5/2012 Allen et al.
2012/0131937 A1 5/2012 Vandermeulen et al.
2012/0131938 A1 5/2012 Vandermeulen et al.
2012/0131939 A1 5/2012 Vandermeulen et al.
2012/0132513 A1 5/2012 Vandermeulen et al.
2012/0152318 A1 6/2012 Kee
2012/0186281 A1 7/2012 Vandermeulen et al.
2013/0056177 A1 3/2013 Coutu et al.
2013/0101909 A1 4/2013 Fasold et al.
2013/0186121 A1 7/2013 Erb et al.
2013/0199220 A1 8/2013 Ma et al.
2013/0227982 A1 9/2013 Forkosh
2013/0255287 A1 10/2013 Forkosh
2013/0340449 A1 12/2013 Kozubal et al.
2014/0054004 A1 2/2014 LePoudre et al.
2014/0054013 A1 2/2014 LePoudre et al.
2014/0150481 A1 6/2014 Vandermeulen
2014/0150656 A1 6/2014 Vandermeulen
2014/0150657 A1 6/2014 Vandermeulen et al.
2014/0150662 A1 6/2014 Vandermeulen et al.
2014/0223947 A1 8/2014 Ranjan et al.
2014/0245769 A1 9/2014 Vandermeulen et al.
2014/0250935 A1 9/2014 Prochaska et al.
2014/0260367 A1 9/2014 Coutu et al.
2014/0260369 A1 9/2014 LePoudre
2014/0260371 A1 9/2014 Vandermeulen
2014/0260398 A1 9/2014 Kozubal et al.

(56) References Cited

U.S. PATENT DOCUMENTS

| | | | |
|---|---|---|---|
| 2014/0260399 | A1 | 9/2014 | Vandermeulen |
| 2014/0262125 | A1 | 9/2014 | Erb et al. |
| 2014/0262144 | A1 | 9/2014 | Erb et al. |
| 2014/0264968 | A1 | 9/2014 | Erb et al. |
| 2014/0360373 | A1 | 12/2014 | Peacos et al. |
| 2014/0366567 | A1 | 12/2014 | Vandermeulen |
| 2015/0107287 | A1 | 4/2015 | Forkosh |
| 2015/0184876 | A1 | 7/2015 | Vandermeulen et al. |
| 2015/0300754 | A1 | 10/2015 | Vandermeulen et al. |
| 2015/0323216 | A1 | 11/2015 | Wallin |
| 2015/0338140 | A1 | 11/2015 | Vandermeulen |
| 2016/0187011 | A1 | 6/2016 | Vandermeulen |
| 2016/0290665 | A1 | 10/2016 | Vandermeulen et al. |
| 2016/0290666 | A1 | 10/2016 | Coutu et al. |
| 2017/0074530 | A1 | 3/2017 | Kozubal |
| 2017/0102155 | A1 | 4/2017 | Vandermeulen |
| 2017/0106639 | A1 | 4/2017 | Vandermeulen et al. |
| 2017/0167794 | A1 | 6/2017 | Vandermeulen |
| 2017/0184319 | A1 | 6/2017 | Vandermeulen et al. |
| 2017/0292722 | A1 | 10/2017 | Vandermeulen |
| 2018/0051897 | A1 | 2/2018 | Vandermeulen et al. |
| 2018/0163977 | A1 | 6/2018 | Vandermeulen |
| 2020/0096241 | A1 | 3/2020 | Vandermeulen |

FOREIGN PATENT DOCUMENTS

| | | | |
|---|---|---|---|
| CN | 100476308 | C | 4/2009 |
| CN | 101636630 | A | 1/2010 |
| CN | 102282426 | A | 12/2011 |
| CN | 202229469 | U | 5/2012 |
| CN | 202734094 | U | 2/2013 |
| EP | 0781972 | A2 | 7/1997 |
| EP | 1120609 | A1 | 8/2001 |
| EP | 1563229 | A1 | 8/2005 |
| EP | 1781995 | A1 | 5/2007 |
| EP | 2256434 | A2 | 12/2010 |
| EP | 2306100 | A1 | 4/2011 |
| EP | 2787293 | A1 | 10/2014 |
| GB | 1172247 | A | 11/1969 |
| JP | S54-77443 | A | 6/1979 |
| JP | S62-297647 | A | 12/1987 |
| JP | 02306067 | A | 12/1990 |
| JP | H03-125830 | A | 5/1991 |
| JP | H03-213921 | A | 9/1991 |
| JP | H08-105669 | A | 4/1996 |
| JP | H09-184692 | A | 7/1997 |
| JP | H10-220914 | A | 8/1998 |
| JP | H11-137948 | A | 5/1999 |
| JP | H11-197439 | A | 7/1999 |
| JP | H11-351700 | A | 12/1999 |
| JP | 2000-230730 | A | 8/2000 |
| JP | 2001-517773 | A | 10/2001 |
| JP | 2002-206834 | A | 7/2002 |
| JP | 2004-524504 | A | 8/2004 |
| JP | 2005-134060 | A | 5/2005 |
| JP | 2006-263508 | A | 10/2006 |
| JP | 2006-529022 | A | 12/2006 |
| JP | 2008/020138 | A | 1/2008 |
| JP | 2009-517622 | A | 4/2009 |
| JP | 04273555 | B2 | 6/2009 |
| JP | 2009-180433 | A | 8/2009 |
| JP | 2009-192101 | A | 8/2009 |
| JP | 2009-281668 | A | 12/2009 |
| JP | 2009-293831 | A | 12/2009 |
| JP | 201054136 | A | 3/2010 |
| JP | 2010-247022 | A | 11/2010 |
| JP | 2011064359 | A | 3/2011 |
| JP | 2011-511244 | A | 4/2011 |
| JP | 201192815 | A | 5/2011 |
| JP | 2011-163682 | A | 8/2011 |
| JP | 2012-073013 | A | 4/2012 |
| JP | 2013-064549 | A | 4/2013 |
| KR | 10-2001-0017939 | A | 3/2001 |
| KR | 2004-0026242 | | 3/2004 |
| KR | 10-0510774 | B1 | 8/2005 |
| KR | 2014-0022785 | A | 2/2014 |
| TW | 201009269 | A | 3/2010 |
| WO | WO-1997021061 | A1 | 6/1997 |
| WO | WO-1999022180 | A1 | 5/1999 |
| WO | WO-2000011426 | A1 | 3/2000 |
| WO | WO-2000055546 | A1 | 9/2000 |
| WO | WO-2002066901 | A1 | 8/2002 |
| WO | WO-2002086391 | A1 | 10/2002 |
| WO | WO-2003004937 | A1 | 1/2003 |
| WO | WO-2004046618 | A1 | 6/2004 |
| WO | WO-2006006177 | A1 | 1/2006 |
| WO | WO-2008037079 | A1 | 4/2008 |
| WO | WO-2009094032 | A1 | 7/2009 |
| WO | WO-2009144880 | A1 | 12/2009 |
| WO | WO-2009157277 | A1 | 12/2009 |
| WO | WO-2011062808 | A1 | 5/2011 |
| WO | 2011150081 | A2 | 12/2011 |
| WO | WO-2011161547 | A2 | 12/2011 |
| WO | 2012071036 | A1 | 5/2012 |
| WO | WO-2012082093 | A1 | 6/2012 |
| WO | WO-2013172789 | A1 | 11/2013 |
| WO | 2014152905 | A1 | 9/2014 |
| WO | 2014201281 | A1 | 12/2014 |
| WO | WO-2015077364 | A1 | 5/2015 |

OTHER PUBLICATIONS

Refrigerant—Random House Kernerman Webster's College Dictionary, "Refrigerant," Random House, <https://thefreedictionary.com/refrigerant> (2010).

Extended European Search Report for EP application No. EP18179986.7 dated Mar. 29, 2019.

Chinese Patent Application 201480013101.0, Office Action dated Mar. 22, 2017.

"Siphon." Encyclopedia Americana. Grolier Online, 2015. Web. Apr. 3, 2015. 1 page.

1—Open Absorption System for Cooling and Air Conditioning using Membrane Contactors—Annual Report 2005, Publication No. Publication 260097, Project: 101310—Open Absorption System for Cooling and Air Conditioning using Membrane Contactors, Date of publication: Jan. 31, 2006, Author: Manuel Conde-Petit, Robert Weber, Contractor: M. Conde Engineering.

2—Open Absorption System for Cooling and Air Conditioning using Membrane Contactors—Annual, Report 2006, Publication No. Publication 260098, Project: 101310—Open Absorption System for Cooling and Air Conditioning using Membrane Contactors, Date of publication: Nov. 14, 2006, Author: Manuel Conde-Petit, Robert Weber, Contractor: M. Conde Engineering.

3—Open Absorption System for Cooling and Air Conditioning Using Membrane Contactors—Final Report, Publication No. Publication 280139, Project: 101310—Open Absorption System for Cooling and Air Conditioning using Membrane Contactors, Date of publication: Jul. 8, 2008, Author: Viktor Dorer, Manuel Conde-Petit, Robert Weber, Contractor: M. Conde Engineering.

4—Conde-Petit, M. 2007. Liquid Desiccant-Based Air-Conditioning Systems—LDACS, Proc. of the 1st European Conference on Polygeneration—Technologies and Applications, 217-234, A. Coronas, ed., Tarragona—Spain, Oct. 16-17, Published by CREVER—Universitat Rovira I Virgili, Tarragona, Spain.

5—Conde-Petit, M. 2008. Open Absorption Systems for Air-Conditioning using Membrane Contactors,Proceedings '15. Schweizerisches Status—Seminar «Energie- und Umweltforschung im Bauwesen»', Sep. 11-12—ETH Zurich, Switzerland. Published by BRENET—Eggwilstr. 16a, CH-9552 Bronschhofen—Switzerland (brenet@vogel-tech.ch).

6—Third Party Observations for PCT/US2011/037936, dated Sep. 24, 2012.

Ashrae, et al., "Desiccant Dehumidification and Pressue Drying Equipment," 2012 Ashrae Handbook—HVAC Systems and Equipment, Chapter 24, pp. 24.1-24.12.

Beccali, et al., "Energy and Economic Assessment of Desiccant Cooling," Solar Energy, Issue 83, pp. 1828-1846, Aug. 2009.

European Search Report for EP147756438.9, dated Nov. 24, 2016.

(56) References Cited

OTHER PUBLICATIONS

Fimbres-Weihs, et al., "Review of 3D CFD modeling of flow and mass transfer in narrow spacer-filled channels in membrane modules," Chemical Engineering and Processing 49 (2010) pp. 759-781.
International Search Report and Written Opinion for PCT/US2014/019470, dated Jun. 2, 2014.
Korean Patent Application 10-2015-7024529, Office Action dated Jul. 28, 2016.
Li, F., et al., "Novel spacers for mass transfer enhancement in membrane separations," Journal of Membrane Science, 253 (2005), pp. 1-12.
Li, Y., et al., "CFD simulation of fluid flow through spacer-filled membrane module: selecting suitable cell types for periodic boundary conditions," Desalination 233 (2008) pp. 351-358.
Liu, et al., "Research Progress in Liquid Desiccant Air Conditioning Devices and Systems," Frontiers of Energy and Power Engineering in China, vol. 4, Issue 1, pp. 55-65, Feb. 2010.
Lowenstein, "A Solar Liquid-Desiccant Air Conditioner," Solar 2003, Proceedings of the 32nd ASES Annual Conference, Austin, TX, Jul. 2003.
Mathioulakis, "Desalination by Using Alternative Energy," Desalination, Issue 203, pp. 346-365, 2007.
Perry "Perry's Chemical Engineers handbook" 1999 McGraw Hill p. 11-52,11-53.
Russell, et al., "Optimization of Photovolatic Thermal Collector Heat Pump Systems," ISES International Solar Energy Conference, Atlanta, GA, vol. 3, pp. 1870-1874, May 1979.
Welty, "Liquid Desiccant Dehumidification," Engineered Systems, May 2010, vol. 27 Issue 5, p. 34.

DESICCANT AIR CONDITIONING METHODS AND SYSTEMS

CROSS-REFERENCE TO RELATED APPLICATIONS

This application is a division of U.S. patent application Ser. No. 14/493,781, filed on Feb. 28, 2014, entitled DESICCANT AIR CONDITIONING SYSTEMS WITH CONDITIONER AND REGENERATOR HEAT TRANSFER FLUID LOOPS, which claims priority from U.S. Provisional Patent Application No. 61/771,340, filed on Mar. 1, 2013, entitled METHODS FOR CONTROLLING 3-WAY HEAT EXCHANGERS IN DESICCANT CHILLERS, both of which are hereby incorporated by reference.

BACKGROUND

The present application relates generally to the use of liquid desiccants to dehumidify and cool, or heat and humidify an air stream entering a space. More specifically, the application relates to the control systems required to operate 2 or 3-way liquid desiccant mass and heat exchangers employing micro-porous membranes to separate the liquid desiccant from an air stream. Such heat exchangers can use gravity induced pressures (siphoning) to keep the micro-porous membranes properly attached to the heat exchanger structure. The control systems for such 2 and 3-way heat exchangers are unique in that they have to ensure that the proper amount liquid desiccant is applied to the membrane structures without over pressurizing the fluid and without over- or under-concentrating the desiccant. Furthermore, the control system needs to respond to demands for fresh air ventilation from the building and needs to adjust to outdoor air conditions, while maintaining a proper desiccant concentration and preventing desiccant crystallization or undue dilution. In addition, the control system needs to be able to adjust the temperature and humidity of the air supplied to a space by reacting to signals from the space such as thermostats or humidistats. The control system also needs to monitor outside air conditions and properly protect the equipment in freezing conditions by lowering the desiccant concentration in such a way as to avoid crystallization.

Liquid desiccants have been used parallel to conventional vapor compression HVAC equipment to help reduce humidity in spaces, particularly in spaces that require large amounts of outdoor air or that have large humidity loads inside the building space itself. Humid climates, such as for example Miami, Fla. require a lot of energy to properly treat (dehumidify and cool) the fresh air that is required for a space's occupant comfort. Conventional vapor compression systems have only a limited ability to dehumidify and tend to overcool the air, oftentimes requiring energy intensive reheat systems, which significantly increase the overall energy costs, because reheat adds an additional heat-load to the cooling system. Liquid desiccant systems have been used for many years and are generally quite efficient at removing moisture from the air stream. However, liquid desiccant systems generally use concentrated salt solutions such as ionic solutions of LiCl, LiBr or $CaCl_2$ and water. Such brines are strongly corrosive, even in small quantities, so numerous attempts have been made over the years to prevent desiccant carry-over to the air stream that is to be treated. In recent years efforts have begun to eliminate the risk of desiccant carry-over by employing micro-porous membranes to contain the desiccant. An example of such as membrane is the EZ2090 poly-propylene, microporous membrane manufactured by Celgard, LLC, 13800 South Lakes Drive Charlotte, N.C. 28273. The membrane is approximately 65% open area and has a typical thickness of about 20 μm. This type of membrane is structurally very uniform in pore size (100 nm) and is thin enough to not create a significant thermal barrier. However such super-hydrophobic membranes are typically hard to adhere to and are easily subject to damage. Several failure modes can occur: if the desiccant is pressurized the bonds between the membrane and its support structure can fail, or the membrane's pores can distort in such a way that they no longer are able to withstand the liquid pressure and break-through of the desiccant can occur. Furthermore if the desiccant crystallizes behind the membrane, the crystals can break through the membrane itself creating permanent damage to the membrane and causing desiccant leaks. And in addition the service life of these membranes is uncertain, leading to a need to detect membrane failure or degradation well before any leaks may even be apparent.

Liquid desiccant systems generally have two separate functions. The conditioning side of the system provides conditioning of air to the required conditions, which are typically set using thermostats or humidistats. The regeneration side of the system provides a reconditioning function of the liquid desiccant so that it can be re-used on the conditioning side. Liquid desiccant is typically pumped between the two sides which implies that the control system also needs to ensure that the liquid desiccant is properly balanced between the two sides as conditions necessitate and that excess heat and moisture are properly dealt with without leading to over-concentrating or under-concentrating the desiccant.

There thus remains a need for a control system that provides a cost efficient, manufacturable, and efficient method to control a liquid desiccant system in such a way as to maintain proper desiccant concentrations, fluid levels, react to space temperature and humidity requirements, react to space occupancy requirements and react to outdoor air conditions, while protecting the system against crystallization and other potentially damaging events. The control system furthermore needs to ensure that subsystems are balanced properly and that fluid levels are maintained at the right set-points. The control system also needs to warn against deterioration or outright failures of the liquid desiccant membrane system.

BRIEF SUMMARY

Provided herein are methods and systems used for the efficient dehumidification of an air stream using a liquid desiccant. In accordance with one or more embodiments, the liquid desiccant is running down the face of a support plate as a falling film. In accordance with one or more embodiments, the desiccant is contained by a microporous membrane and the air stream is directed in a primarily vertical orientation over the surface of the membrane and whereby both latent and sensible heat are absorbed from the air stream into the liquid desiccant. In accordance with one or more embodiments, the support plate is filled with a heat transfer fluid that preferably flows in a direction counter to the air stream. In accordance with one or more embodiments, the system comprises a conditioner that removes latent and sensible heat through the liquid desiccant and a regenerator that removes the latent and sensible heat from the system. In accordance with one or more embodiments, the heat transfer fluid in the conditioner is cooled by a refrigerant compressor or an external source of cold heat transfer fluid. In accordance with one or more embodiments, the regenerator is heated by a refrigerant compressor or an external source of hot heat transfer fluid. In accordance with one or more embodiments, the cold heat transfer fluid can bypass the conditioner and the hot heat transfer fluid can bypass the regenerator thereby allowing independent control of supply air temperature and relative humidity. In accordance with one or more embodiments, the conditioner's cold heat transfer fluid is additionally directed through a cooling coil and the regenerator's hot heat transfer fluid is additionally directed through a heating coil. In accordance with one or more embodiments, the hot heat transfer fluid has an independent method or rejecting heat, such as through an additional coil or other appropriate heat transfer mechanism. In accordance with one or more embodiments, the system has multiple refrigerant loops or multiple heat transfer fluid loops to achieve similar effects for controlling air temperature on the conditioner and liquid desiccant concentration by controlling the regenerator temperature. In one or more embodiments, the heat transfer loops are serviced by separate pumps. In one or more embodiments, the heat transfer loops are services by a single shared pump. In one or more embodiments, the refrigerant loops are independent. In one or more embodiments, the refrigerant loops are coupled so that one refrigerant loop only handles half the temperature difference between the conditioner and the regenerator and the other refrigerant loop handles the remaining temperature difference, allowing each loop to function more efficiently.

In accordance with one or more embodiments, a liquid desiccant system employs a heat transfer fluid on a conditioner side of the system and a similar heat transfer fluid loop on a regenerator side of the system wherein the heat transfer fluid can optionally be directed from the conditioner to the regenerator side of the system through a switching valve, thereby allowing heat to be transferred through the heat transfer fluid from the regenerator to the conditioner. The mode of operation is useful in case where the return air from the space that is directed through the regenerator is higher in temperature than the outside air temperature and the heat from the return air can be thus be used to heat the incoming supply air stream.

In accordance with one or more embodiments, the refrigerant compressor system is reversible so that heat from the compressor is directed to the liquid desiccant conditioner and heat is removed by the refrigerant compressor from the regenerator thereby reversing the conditioner and regeneration functions. In accordance with one or more embodiments, the heat transfer fluid is reversed but no refrigerant compressor is utilized and external sources of cold and hot heat transfer fluids are utilized thereby allowing heat to be transferred from one side of the system to the opposite side of the system. In accordance with one or more embodiments, the external sources of cold and hot heat transfer fluid are idled while heat is transferred from one side to the other side of the system.

In accordance with one or more embodiments, a liquid desiccant membrane system employs an indirect evaporator to generate a cold heat transfer fluid wherein the cold heat transfer fluid is used to cool a liquid desiccant conditioner. Furthermore, in one or more embodiments, the indirect evaporator receives a portion of the air stream that was earlier treated by the conditioner. In accordance with one or more embodiments, the air stream between the conditioner and indirect evaporator is adjustable through some convenient means, for example through a set of adjustable louvers or through a fan with adjustable fan speed. In accordance with one or more embodiments, the heat transfer fluid between the conditioner and indirect evaporator is adjustable so that the air that is treated by the conditioner is also adjustable by regulating the heat transfer fluid quantity passing through the conditioner. In accordance with one or more embodiments, the indirect evaporator can be idled and the heat transfer fluid can be directed between the conditioner and a regenerator is such a fashion that heat from return air from a space is recovered in the regenerator and is directed to provide heating to air directed through the conditioner.

In accordance with one or more embodiments, the indirect evaporator is used to provide heated, humidified air to a supply air stream to a space while a conditioner is simultaneously used to provide heated, humidified air to the same space. This allows the system to provide heated, humidified air to a space in winter conditions. The conditioner is heated and is desorbing water vapor from a desiccant and the indirect evaporator can be heated as well and is desorbing water vapor from liquid water. In one or more embodiments, the water is seawater. In one or more embodiments, the water is waste water. In one or more embodiments, the indirect evaporator uses a membrane to prevent carry-over of non-desirable elements from the seawater or waste water. In one or more embodiments, the water in the indirect evaporator is not cycled back to the top of the indirect evaporator such as would happen in a cooling tower, but between 20% and 80% of the water is evaporated and the remainder is discarded.

In accordance with one or more embodiments, a liquid desiccant conditioner receives cold or warm water from an indirect evaporator. In one or more embodiments, the indirect evaporator has a reversible air stream. In one or more embodiments, the reversible air stream creates a humid exhaust air stream in summer conditions and creates a humid supply air stream to a space in winter conditions. In one or more embodiments, the humid summer air stream is discharged from the system and the cold water that is generated is used to chill the conditioner in summer conditions. In one or more embodiments, the humid winter air stream is used to humidify the supply air to a space in combination with a conditioner. In one or more embodiments, the air streams are variable by a variable speed fan. In one or more embodiments, the air streams are variable through a louver mechanism or some other suitable method. In one or more embodiments, the heat transfer fluid between the indirect evaporator and the conditioner can be directed through the regenerator as well, thereby absorbing heat from the return air from a space and delivering such heat to the supply air stream for that space. In one or more embodiments, the heat transfer fluid receives supplemental heat or cold from external sources. In one or more embodiments, such external sources are geothermal loops, solar water loops or heat loops from existing facilities such as Combined Heat and Power systems.

In accordance with one or more embodiments, a conditioner receives an air stream that is pulled through the conditioner by a fan while a regenerator receives an air stream that is pulled through the regenerator by a second fan. In one or more embodiments, the air stream entering the conditioner comprises a mixture of outside air and return air. In one or more embodiments, the amount of return air is zero and the conditioner receives solely outside air. In one or more embodiments, the regenerator receives a mixture of outside air and return air from a space. In one or more embodiments, the amount of return air is zero and the regenerator receives only outside air. In one or more embodiments, louvers are used to allow some air from the regenerator side of the system to be passed to the conditioner side of the system. In one or more embodiments, the pressure in the conditioner is below the ambient pressure. In further embodiments the pressure in the regenerator is below the ambient pressure.

In accordance with one or more embodiments, a conditioner receives an air stream that is pushed through the conditioner by a fan resulting in a pressure in the conditioner that is above the ambient pressure. In one or more embodiments, such positive pressure aids in ensuring that a membrane is held flat against a plate structure. In one or more embodiments, a regenerator receives an air stream that is pushed through the regenerator by a fan resulting in a pressure in the regenerator that is above ambient pressure. In one or more embodiments, such positive pressure aids in ensuring that a membrane is held flat against a plate structure.

In accordance with one or more embodiments, a conditioner receives an air stream that is pushed through the conditioner by a fan resulting in a positive pressure in the conditioner that is above the ambient pressure. In one or more embodiments, a regenerator receives an air stream that is pulled through the regenerator by a fan resulting in a negative pressure in the regenerator compared to the ambient pressure. In one or more embodiments, the air stream entering the regenerator comprises a mixture of return air from a space and outside air that is being delivered to the regenerator from the conditioner air stream.

In accordance with one or more embodiments, an air stream's lowest pressure point is connected through some suitable means such as through a hose or pipe to an air pocket above a desiccant reservoir in such a way as to ensure that the desiccant is flowing back from a conditioner or regenerator membrane module through a siphoning action and wherein the siphoning is enhanced by ensuring that the lowest pressure in the system exists above the desiccant in the reservoir. In one or more embodiments, such siphoning action ensures that a membrane is held in a flat position against a support plate structure.

In accordance with one or more embodiments, an optical or other suitable sensor is used to monitor air bubbles that are leaving a liquid desiccant membrane structure. In one or more embodiments, the size and frequency of air bubbles is used as an indication of membrane porosity. In one or more embodiments, the size and frequency of air bubbles is used to predict membrane aging or failure.

In accordance with one or more embodiments, a desiccant is monitored in a reservoir by observing the level of the desiccant in the reservoir. In one or more embodiments, the level is monitored after initial startup adjustments have been discarded. In one or more embodiments, the level of desiccant is used as an indication of desiccant concentration. In one or more embodiments, the desiccant concentration is also monitored through the humidity level in the air stream exiting a membrane conditioner or membrane regenerator. In one or more embodiments, a single reservoir is used and liquid desiccant is siphoning back from a conditioner and a regenerator through a heat exchanger. In one or more embodiments, the heat exchanger is located in the desiccant loop servicing the regenerator. In one or more embodiments, the regenerator temperature is adjusted based on the level of desiccant in the reservoir.

In accordance with one or more embodiments, a conditioner receives a desiccant stream and employs siphoning to return the used desiccant to a reservoir. In one or more embodiments, a pump or similar device takes desiccant from the reservoir and pumps the desiccant through a valve and heat exchanger to a regenerator. In one or more embodiments, the valve can be switched so that the desiccant flows to the conditioner instead of flowing through the heat exchanger. In one or more embodiments, a regenerator receives a desiccant stream and employs siphoning to return the used desiccant to a reservoir. In one or more embodiments, a pump or similar device takes desiccant from a reservoir and pumps the desiccant through a heat exchanger and valve assembly to a conditioner. In one or more embodiments, the valve assembly can be switched to pump the desiccant to the regenerator instead of to the conditioner. In one or more embodiments, the heat exchanger can be bypassed. In one or more embodiments, the desiccant is used to recover latent and/or sensible heat from a return air stream and apply the latent heat to a supply air stream by bypassing the heat exchanger. In one or more embodiments, the regenerator is switched on solely when regenerator of desiccant is required. In one or more embodiments, the switching of the desiccant stream is used to control the desiccant concentration.

In accordance with one or more embodiments, a membrane liquid desiccant plate module uses an air pressure tube to ensure that the lowest pressure in the air stream is applied to the air pocket above the liquid desiccant in a reservoir. In one or more embodiments, the liquid desiccant fluid loop uses an expansion volume near the top of the membrane plate module to ensure constant liquid desiccant flow to the membrane plate module.

In accordance with one or more embodiments, a liquid desiccant membrane module is positioned above a sloped drain pan structure, wherein any liquid leaking from the membrane plate module is caught and directed towards a liquid sensor that sends a signal to a control system warning that a leak or failure in the system has occurred. In one or more embodiments, such a sensor detects the conductance of the fluid. In one or more embodiments, the conductance is an indication of which fluid is leaking from the membrane module.

In no way is the description of the applications intended to limit the disclosure to these applications. Many construction variations can be envisioned to combine the various elements mentioned above each with its own advantages and disadvantages. The present disclosure in no way is limited to a particular set or combination of such elements.

DETAILED DESCRIPTION

Figure 1:
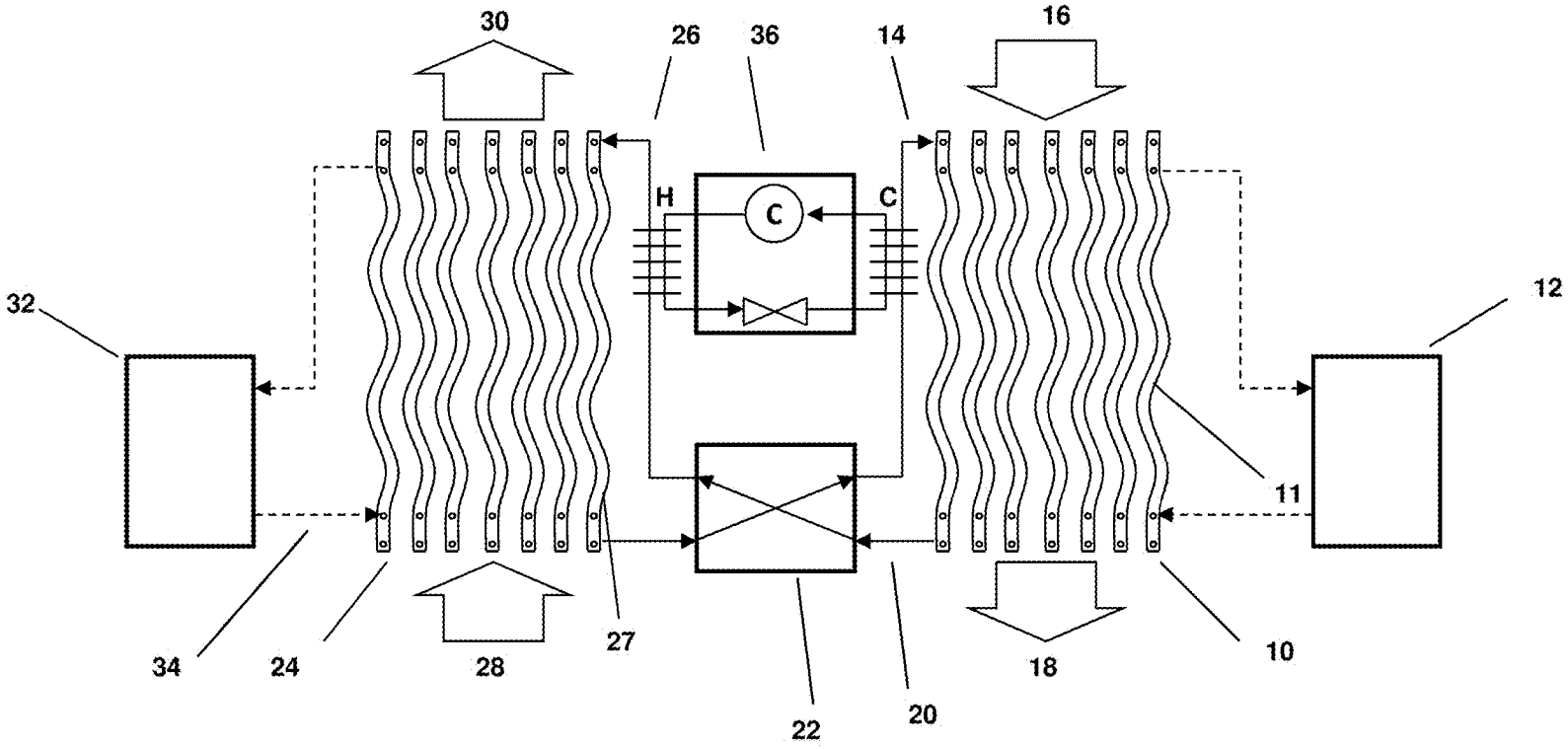
FIG. 1 illustrates a 3-way liquid desiccant air conditioning system using a chiller or external heating or cooling sources.

FIG. 1 depicts a new type of liquid desiccant system as described in more detail in U.S. Patent Application Publication No. 2012/0125020 entitled METHODS AND SYSTEMS FOR DESICCANT AIR CONDITIONING USING PHOTOVOLTAIC-THERMAL (PVT) MODULES. A conditioner 10 comprises a set of plate structures 11 that are internally hollow. A cold heat transfer fluid is generated in cold source 12 and entered into the plates. Liquid desiccant solution at 14 is brought onto the outer surface of the plates 11 and runs down the outer surface of each of the plates 11. The liquid desiccant runs behind a thin membrane that is located between the air flow and the surface of the plates 11. Outside air 16 is now blown through the set of wavy plates 11. The liquid desiccant on the surface of the plates attracts the water vapor in the air flow and the cooling water inside the plates 11 helps to inhibit the air temperature from rising. The treated air 18 is put into a building space.

The liquid desiccant is collected at the bottom of the wavy plates at 20 and is transported through a heat exchanger 22 to the top of the regenerator 24 to point 26 where the liquid desiccant is distributed across the wavy plates of the regenerator. Return air or optionally outside air 28 is blown across the regenerator plate and water vapor is transported from the liquid desiccant into the leaving air stream 30. An optional heat source 32 provides the driving force for the regeneration. The hot transfer fluid 34 from the heat source can be put inside the wavy plates of the regenerator similar to the cold heat transfer fluid on the conditioner. Again, the liquid desiccant is collected at the bottom of the wavy plates 27 without the need for either a collection pan or bath so that also on the regenerator the air can be vertical. An optional heat pump 36 can be used to provide cooling and heating of the liquid desiccant. It is also possible to connect a heat pump between the cold source 12 and the hot source 32, which is thus pumping heat from the cooling fluids rather than the desiccant.

Figure 2A:
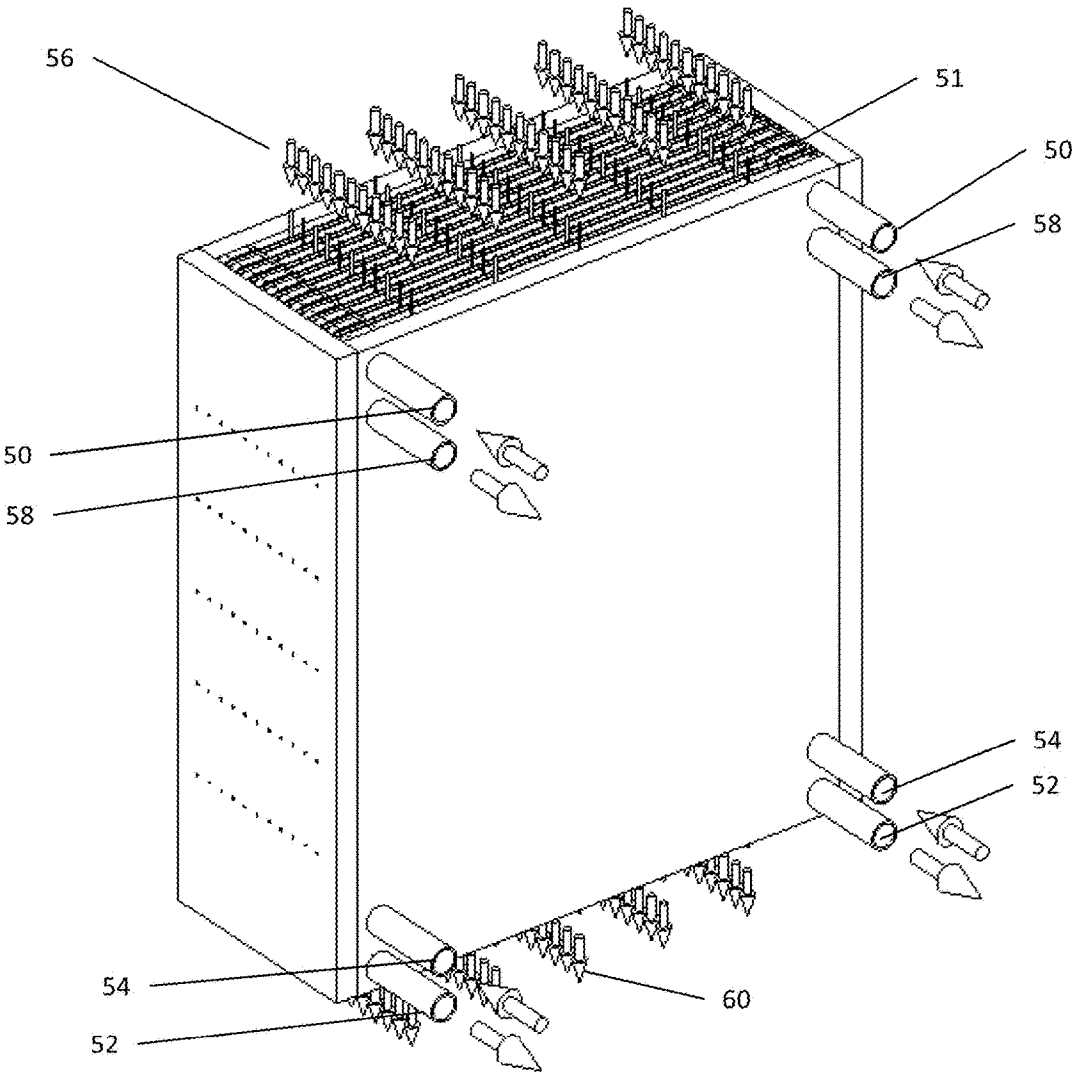
FIG. 2A shows a flexibly configurable membrane module that incorporates 3-way liquid desiccant plates.

FIG. 2A describes a 3-way heat exchanger as described in more detail in U.S. patent application Ser. No. 13/915,199 filed on Jun. 11, 2013 entitled METHODS AND SYSTEMS FOR TURBULENT, CORROSION RESISTANT HEAT EXCHANGERS. A liquid desiccant enters the structure through ports 50 and is directed behind a series of membranes on plate structures 51 as described in FIG. 1. The liquid desiccant is collected and removed through ports 52. A cooling or heating fluid is provided through ports 54 and runs counter to the air stream 56 inside the hollow plate structures, again as described in FIG. 1 and in more detail in FIG. 2B. The cooling or heating fluids exit through ports 58. The treated air 60 is directed to a space in a building or is exhausted as the case may be.

Figure 2B:
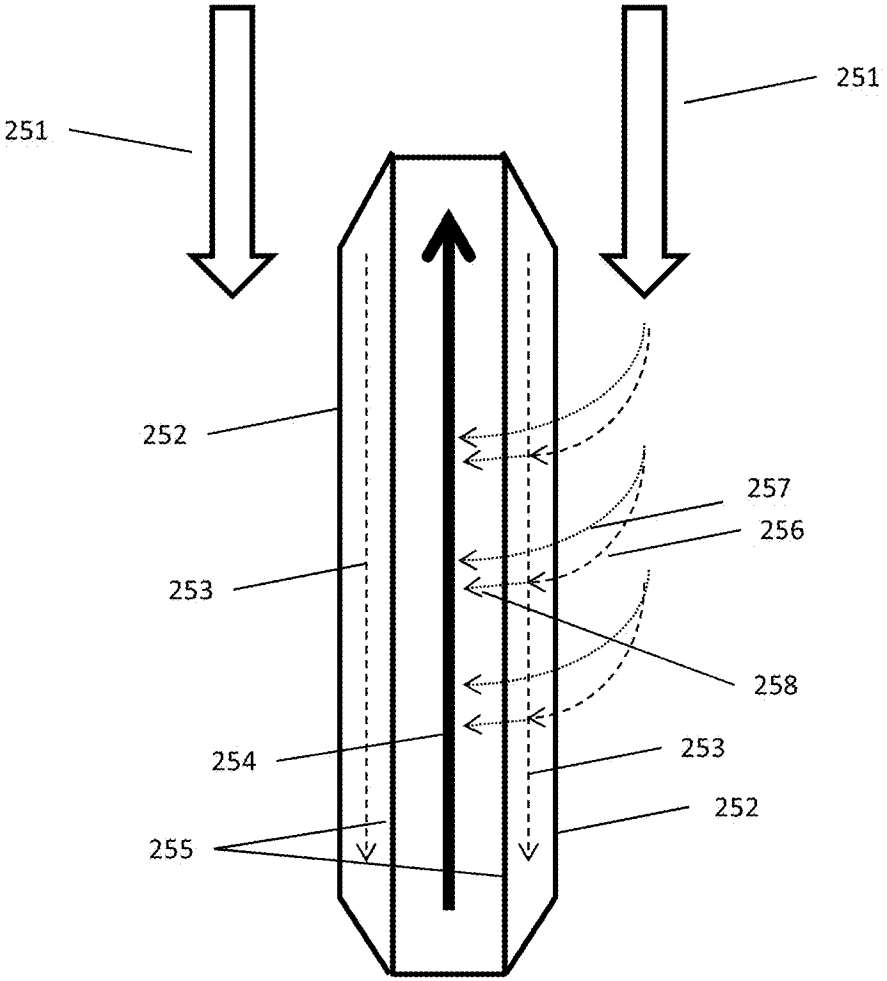
FIG. 2B illustrates a concept of a single membrane plate in the liquid desiccant membrane module of FIG. 2A.

FIG. 2B shows a schematic detail of one of the plates of FIG. 1. The air stream 251 flows counter to a cooling fluid stream 254. Membranes 252 contain a liquid desiccant 253 that is falling along the wall 255 that contain a heat transfer fluid 254. Water vapor 256 entrained in the air stream is able to transition the membrane 252 and is absorbed into the liquid desiccant 253. The heat of condensation of water 258 that is released during the absorption is conducted through the wall 255 into the heat transfer fluid 254. Sensible heat 257 from the air stream is also conducted through the membrane 252, liquid desiccant 253 and wall 255 into the heat transfer fluid 254.

Figure 3A:
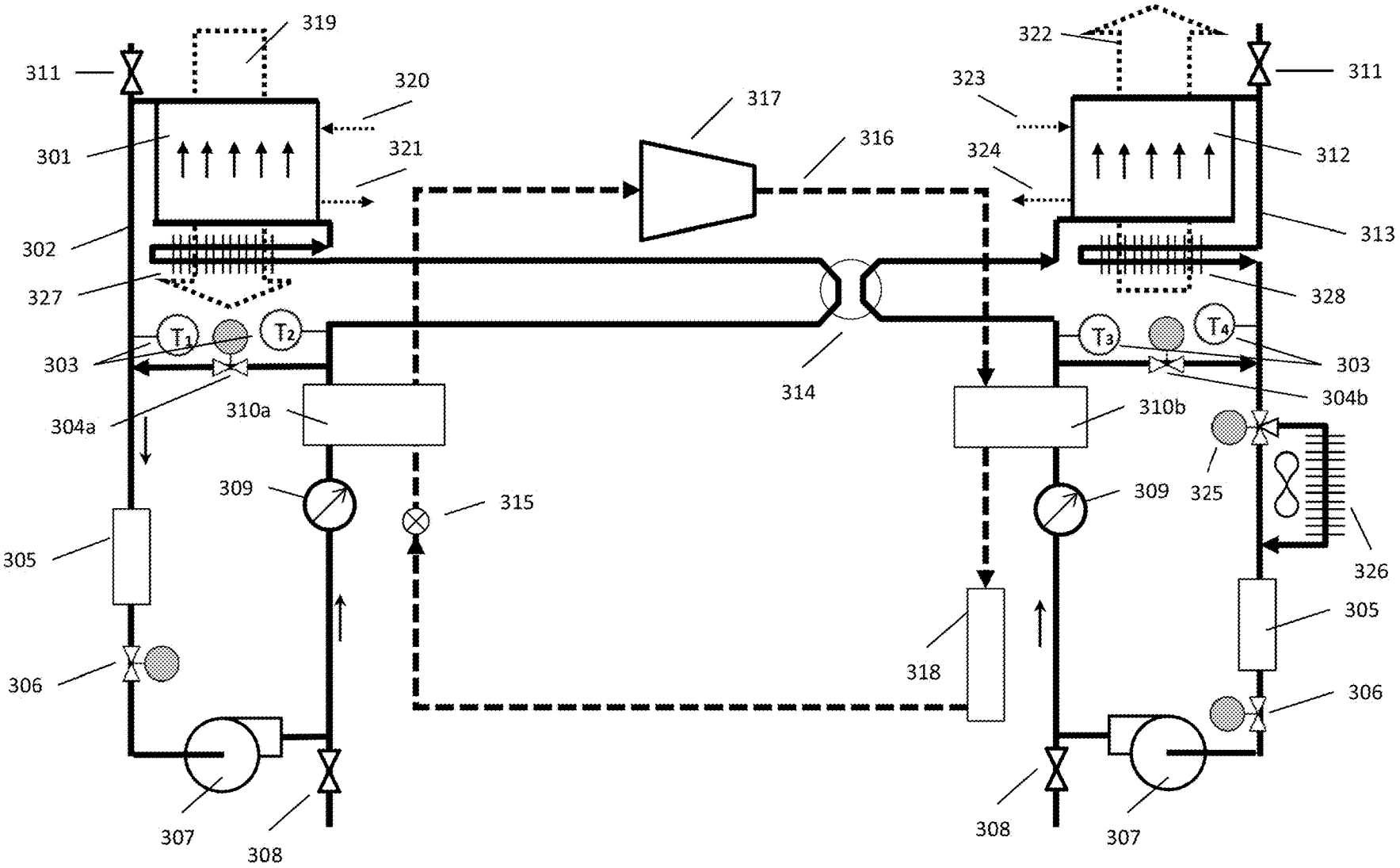
FIG. 3A depicts the cooling fluid control system and chiller refrigerant circuit of a 3-way liquid desiccant system in cooling mode in accordance with one or more embodiments.

FIG. 3A illustrates a simplified control schematic for the fluid paths of FIG. 1 in a summer cooling mode arrangement, wherein a heat pump 317 is connected between the cold cooling fluid entering a liquid desiccant membrane conditioner 301 and the hot heating fluid entering a liquid desiccant membrane regenerator 312. The conditioner and regenerator are membrane modules similar to the membrane module depicted in FIG. 2A and have plates similar to the concept in FIG. 2B. The 3-way conditioner 301 receives an air stream 319 that is to be treated in the 3-way conditioner module. The 3-way conditioner also receives a concentrated desiccant stream 320 and a diluted desiccant stream 321 leaves the conditioner module. For simplicity, the liquid desiccant flow diagrams have been omitted from the figure and will be shown separately in later figures. A heat transfer fluid 302 which is commonly water, water/glycol or some other suitable heat transfer fluid, enters the 3-way module and removes the latent and sensible heat that has been removed from the air stream. Controlling the flow rate and pressure of the heat transfer fluid is critical to the performance of the 3-way module as is described in U.S. patent application Ser. No. 13/915,199. A circulating pump 307 is chosen to provide high fluid flow with low head pressure. The module's plates (shown in FIGS. 1 and 2A) have large surface areas and operate best under slightly negative pressure as compared to the ambient air pressure. The flow is set up in such a way that the heat transfer fluid 302 undergoes a siphoning effect to drain the fluid from the conditioner module 301. Using a siphoning effect makes a marked improvement on the flatness of the module plates since the liquid pressure is not pushing the plates apart. This siphoning effect is achieved by letting the heat transfer fluid 302 fall into a fluid collection tank 305. Temperature sensors 303 located in the heat transfer fluid before and after the 3-way module and the flow sensor 309, allow one to measure in the thermal load captured in the heat transfer fluid. Pressure relief valve 311 is normally open and ensures that the heat transfer fluid is not pressurized which could damage the plate system. Service valves 306 and 308 are normally only used during service events. A liquid to refrigerant heat exchanger 310*a* allows the thermal load to be transferred from the heat transfer fluid to a refrigeration loop 316. A bypass valve 304*a* allows a portion of the low temperature heat transfer fluid to bypass the 3-way conditioner. This has the effect as to lower the flow rate through the 3-way conditioner and as a result the conditioner will operate at higher temperatures. This in turn allows one to control the temperature of the supply air to the space. One could also use a variable flow of the liquid pump 307, which will change the flow rate through the heat exchanger 310*a*. An optional post-cooling coil element 327 ensures that the treated air temperature supplied to the space is very close to the heat transfer fluid temperature.

A refrigerant compressor/heat pump 317 compresses a refrigerant moving in a circuit 316. The heat of compression is rejected into a refrigerant heat exchanger 310*b*, collected into an optional refrigerant receiver 318 and expanded in an expansion valve 315 after which it is directed to the refrigerant heat exchanger 310*a*, where the refrigerant picks up heat from the 3-way conditioner and is returned to the compressor 317. As can be seen in the figure, the liquid circuit 313 around the regenerator 312 is very similar to that around the conditioner 301. Again, the siphoning method is employed to circulate the heat transfer fluid through the regenerator module 312. However, there are two considerations that are different in the regenerator. First, it is oftentimes not possible to receive the same amount of return air 322 from a space as is supplied to that space 319. In other words, air flows 319 and 322 are not balanced and can sometimes vary by more than 50%. This is so that the space remains positively pressurized compared to the surrounding environment to prevent moisture infiltration into the building. Second, the compressor itself adds an additional heat load that needs to be removed. This means that one has to either add additional air to the return air from the building, or one has to have another way of rejecting the heat from the system. Fan-coil 326 utilizes an independent radiator coil and can be used to achieve the additional cooling that is required. It should be understood that other heat rejection mechanism besides a fan coil could be employed such as a cooling tower, ground source heat dump etc. Optional diverter valve 325 can be employed to bypass the fan coil if desired. An optional pre-heating coil 328 is used to preheat the air entering the regenerator. It should be clear that the return air 322 could be mixed with outdoor air or could even be solely outdoor air.

The desiccant loop (details of which will be shown in later figures) provides diluted desiccant to the regenerator module 312 through port 323. Concentrated desiccant is removed at port 324 and directed back to the conditioner module to be reused. Control of the air temperature and thus the regeneration effect is again achieved through an optional diverter valve 304*b* similar to valve 304*a* in the conditioner circuit. The control system is thus able to control both the conditioner and regenerator air temperatures independently and without pressurizing the membrane plate module plates.

Figure 3B:
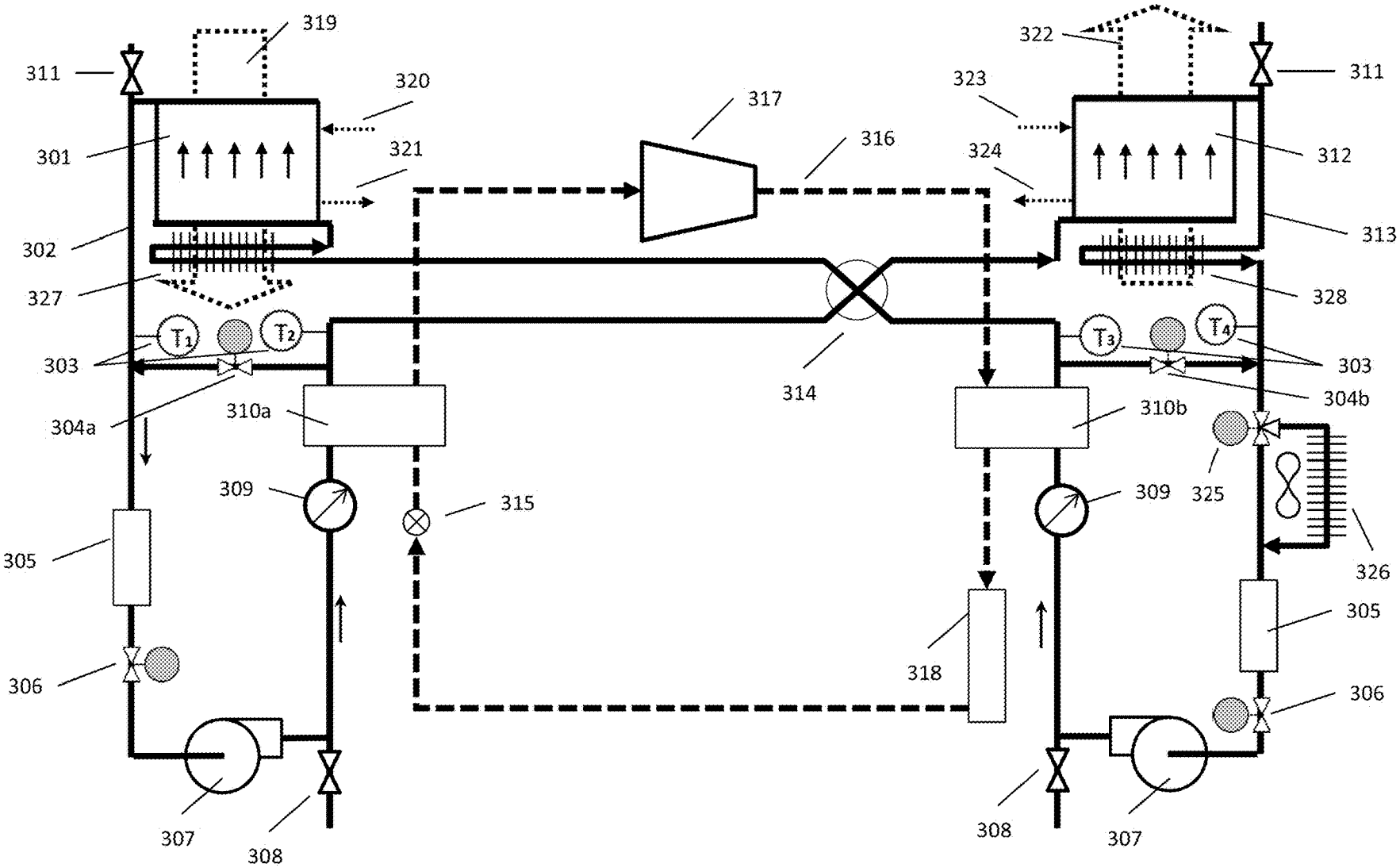
FIG. 3B shows the system of FIG. 3A with the cooling fluid flow connecting the return air and supply air of the building and the chiller in idle mode providing an energy recovery capability between the return air and the supply air in accordance with one or more embodiments.

Also in FIG. 3A is shown a diverter valve 314. This valve is normally separating the conditioner and regenerator circuits. But in certain conditions the outside air needs little if any cooling. In FIG. 3B the diverter valve 314 has been opened to allow the conditioner and regenerator circuits to be connected creating an energy recovery mode. This allows the sensible heat from the return air 322 to be coupled to the incoming air 319 essentially providing a sensible energy recovery mechanism. In this operating mode the compressor 317 would normally be idled.

Figure 3C:
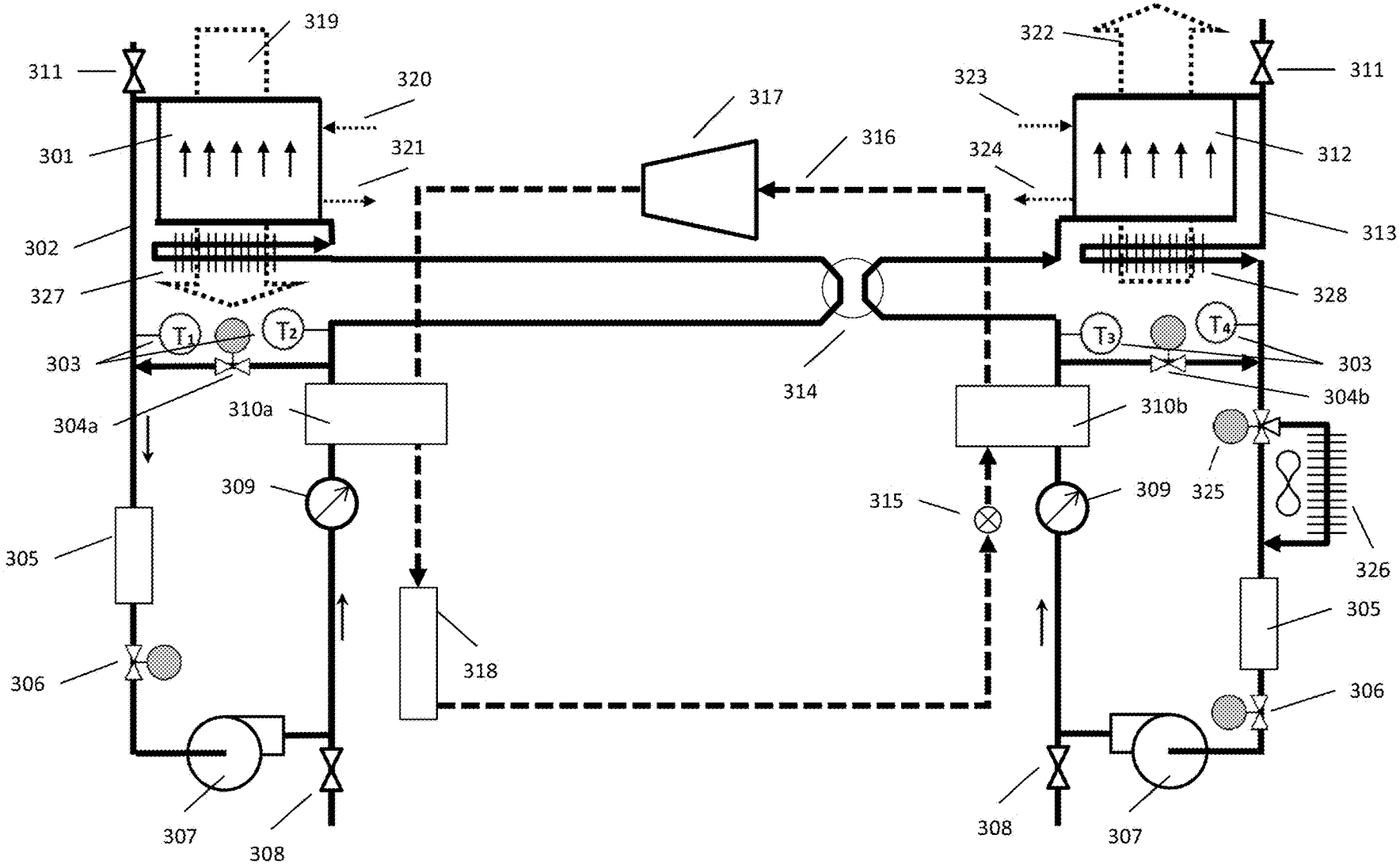
FIG. 3C illustrates the system of FIG. 3A with the chiller in reverse mode supplying heat to the supply air and retrieving heat from the return air in accordance with one or more embodiments.

FIG. 3C shows how the system operates in winter heating mode. The compressor 317 is now operating in a reversed direction (for ease of the figure the refrigerant is shown flowing in the opposite direction—in actuality a 4-way reversible refrigerant circuit would most likely be employed). Diverter valve 314 is again closed so that the conditioner and regenerator are thermally isolated. The heat is essentially pumped from the return air 322 (which can be mixed with outdoor air) into the supply air 319. The advantage that such an arrangement has is that the heat transfer (properly protected for freezing) and the liquid desiccant membrane modules are able to operate a much lower temperatures than conventional coils since none of the materials are sensitive to freezing conditions, including the liquid desiccant as long as its concentration is maintained between 15 and 35% in the case of Lithium Chloride.

Figure 4A:
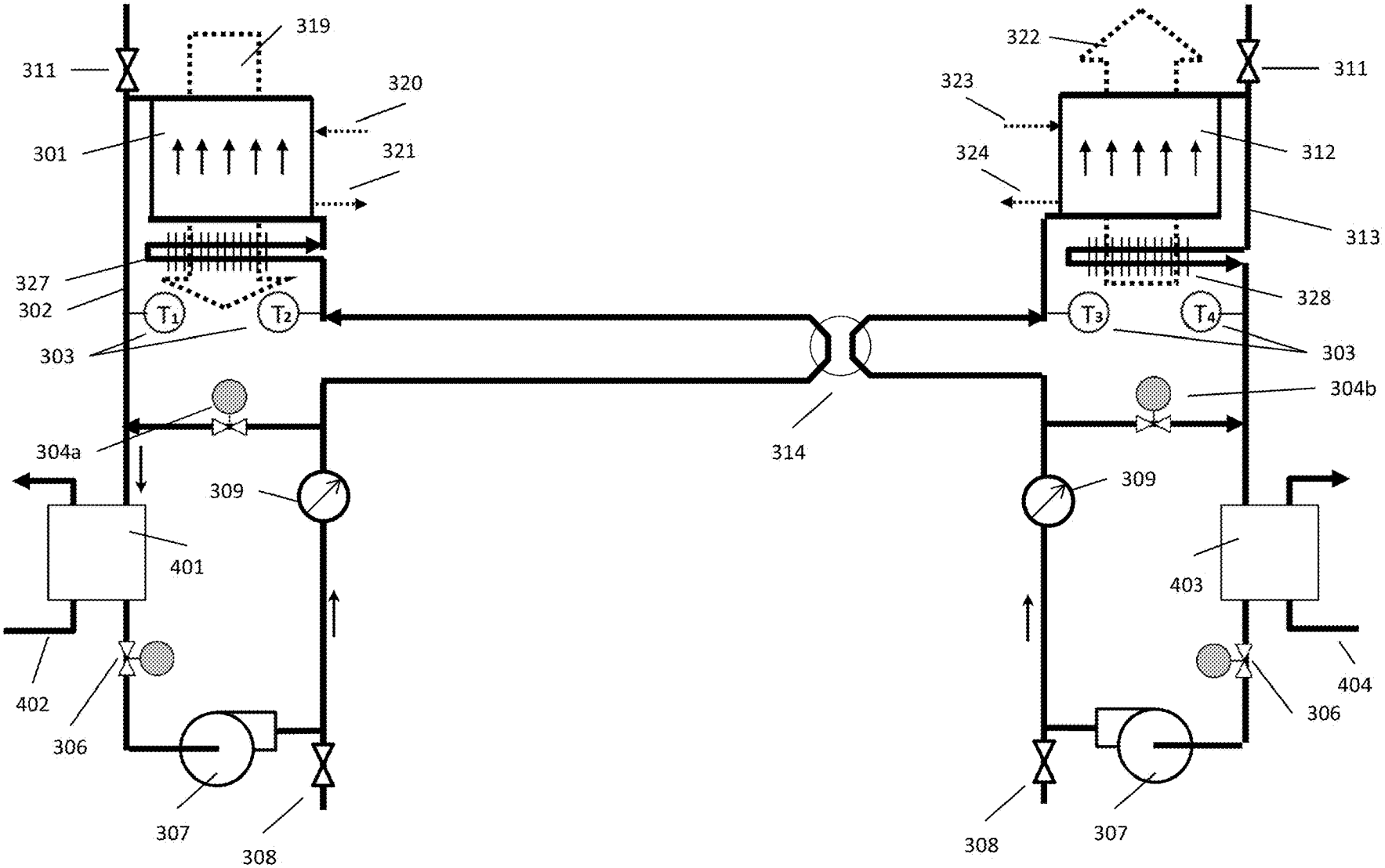
FIG. 4A shows the cooling fluid control circuit of a liquid desiccant membrane system that utilizes external cooling and heating sources in accordance with one or more embodiments.

FIG. 4A illustrates a summer cooling arrangement in a flow diagram similar to that of FIG. 3A however without the use of a refrigeration compressor. Instead, an external cold fluid source 402 is provided using a heat exchanger 401. The external cold fluid source can be any convenient source of cold fluid, such as a geothermal source, a cooling tower, an indirect evaporative cooler or centralized chilled water or chilled brine loop. Similarly FIG. 4A illustrates a hot fluid source 404 that uses heat exchanger 403 to heat the regenerator hot water loop. Again such a hot fluid source can be any convenient hot fluid source such as from a steam loop, solar hot water, a gas furnace or a waste heat source. With the same control valves 304*a* and 304*b* the system is able to control the amount of heat removed from the supply air and added to the return air. In some instances it is possible to eliminate the heat exchangers 401 and 403 and to run the cold or hot fluid directly through the conditioner 301 and/or regenerator 312. This is possible if the external cold or hot fluids are compatible with the conditioner and/or regenerator modules. This can simplify the system while making the system also slightly more energy efficient.

Figure 4B:
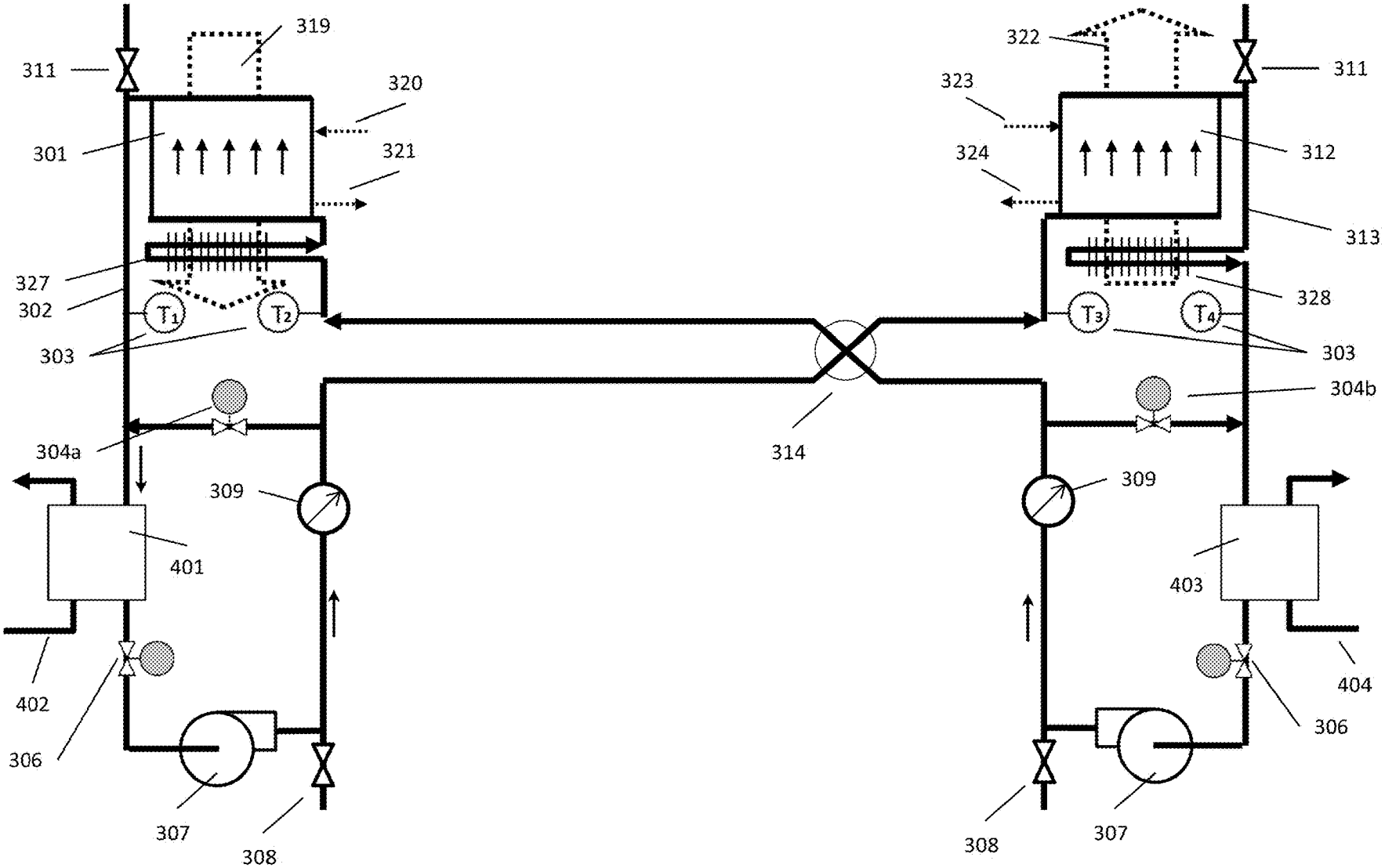
FIG. 4B shows the system of FIG. 4A wherein the cooling fluid provides a sensible heat recovery connection between the return air and the supply air in accordance with one or more embodiments.

Similar to the situation described in FIG. 3B, it is again possible to recover heat from the return air 322 by using the diverter valve 314, as is shown in FIG. 4B. As in FIG. 3B, the hot and cold fluid sources are most likely not operating in this condition so that heat is simply transferred from the return air 322 to the supply air 319.

Figure 5A:
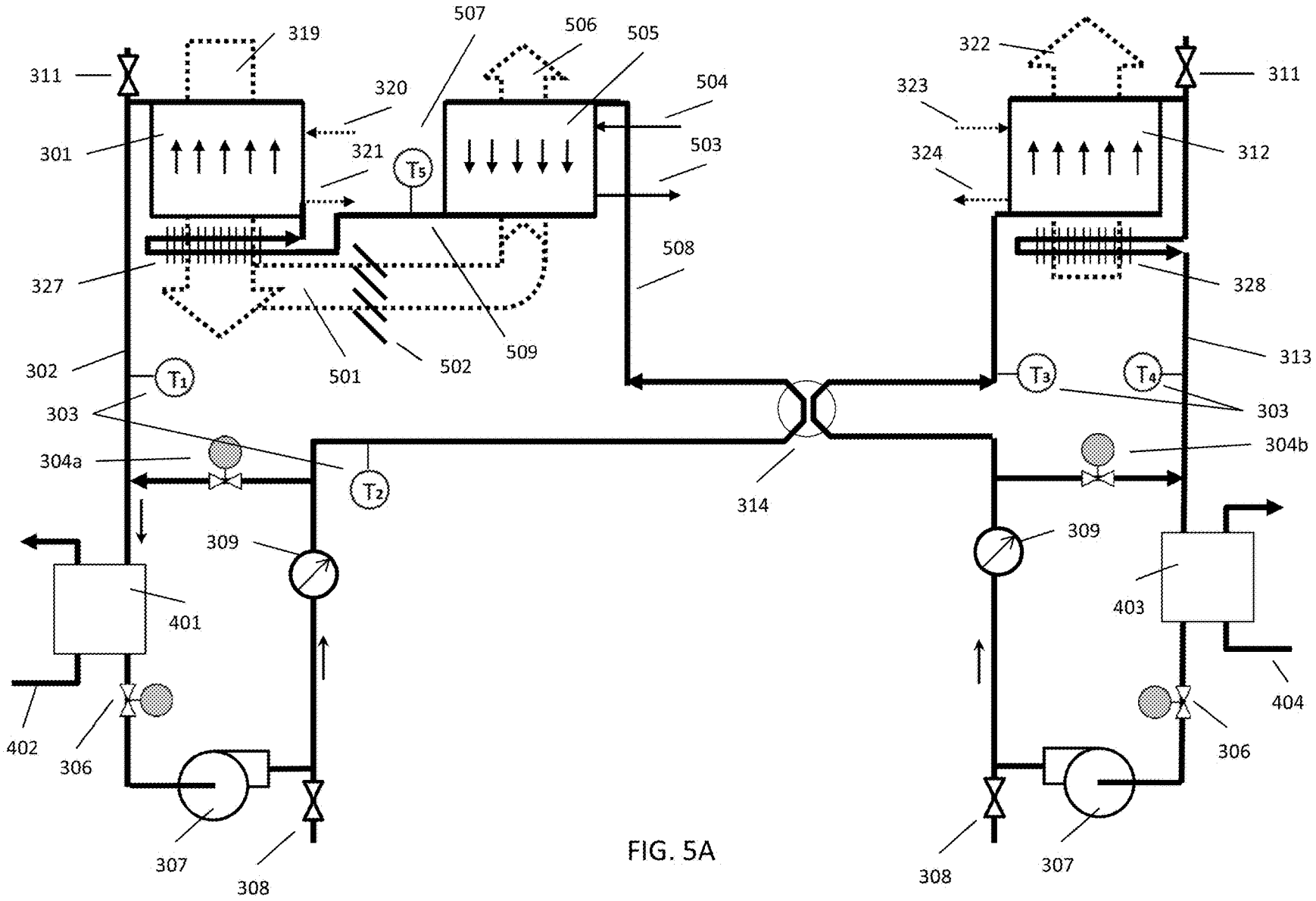
FIG. 5A shows a liquid desiccant air conditioning system utilizing an indirect evaporative cooling module in summer cooling mode in accordance with one or more embodiments.

FIG. 5A shows an alternate summer cooling mode arrangement wherein a portion (typically 20-40%) of the treated air 319 is diverted through a set of louvers 502 into a side air stream 501 that enters a 3-way evaporator module 505. The evaporator module 505 receives a water stream 504 that is to be evaporated and has a leaving residual water stream 503. The water stream 504 can be potable water, sea water or grey water. The evaporator module 505 can be constructed very similar to the conditioner and regenerator modules and can also employ membranes. Particularly when the evaporator module 505 is evaporating seawater or grey water, a membrane will ensure that none of the salts and other materials entrained in the water become air borne. The advantage of using seawater or grey water is that this water is relatively inexpensive in many cases, rather than potable water. Off course seawater and grey water contain many minerals and ionic salts. Therefore the evaporator is set up to evaporate only a portion of the water supply, typically between 50 and 80%. The evaporator is set up as a "once-through" system meaning that the residual water stream 503 is discarded. This is unlike a cooling tower where the cooling water makes many passes through the system. However in cooling towers such passes eventually lead to mineral build up and residue that needs to the be "blown down", i.e., removed. The evaporator in this system does not require a blow down operation since the residues are carried away by the residual water stream 503.

Similar to the conditioner and regenerator modules 301 and 312, the evaporator module 505 receives a stream of heat transfer fluid 508. The transfer fluid enters the evaporator module and the evaporation in the module results in a strong cooling effect on the heat transfer fluid. The temperature drop in the cooling fluid can be measured by temperature sensor 507 in the heat transfer fluid 509 that is leaving the evaporator 505. The cooled heat transfer fluid 509 enters the conditioner module, where it absorbs the heat of the incoming air stream 319. As can be seen in the figure, both the conditioner 319 and the evaporator 505 have a counter flow arrangement of their primary fluids (heat transfer fluid and air) thus resulting in a more efficient transfer of heat. Louvers 502 are used to vary the amount of air that is diverted to the evaporator. The exhaust air stream 506 of the evaporator module 505 carries off the excess evaporated water.

Figure 5B:
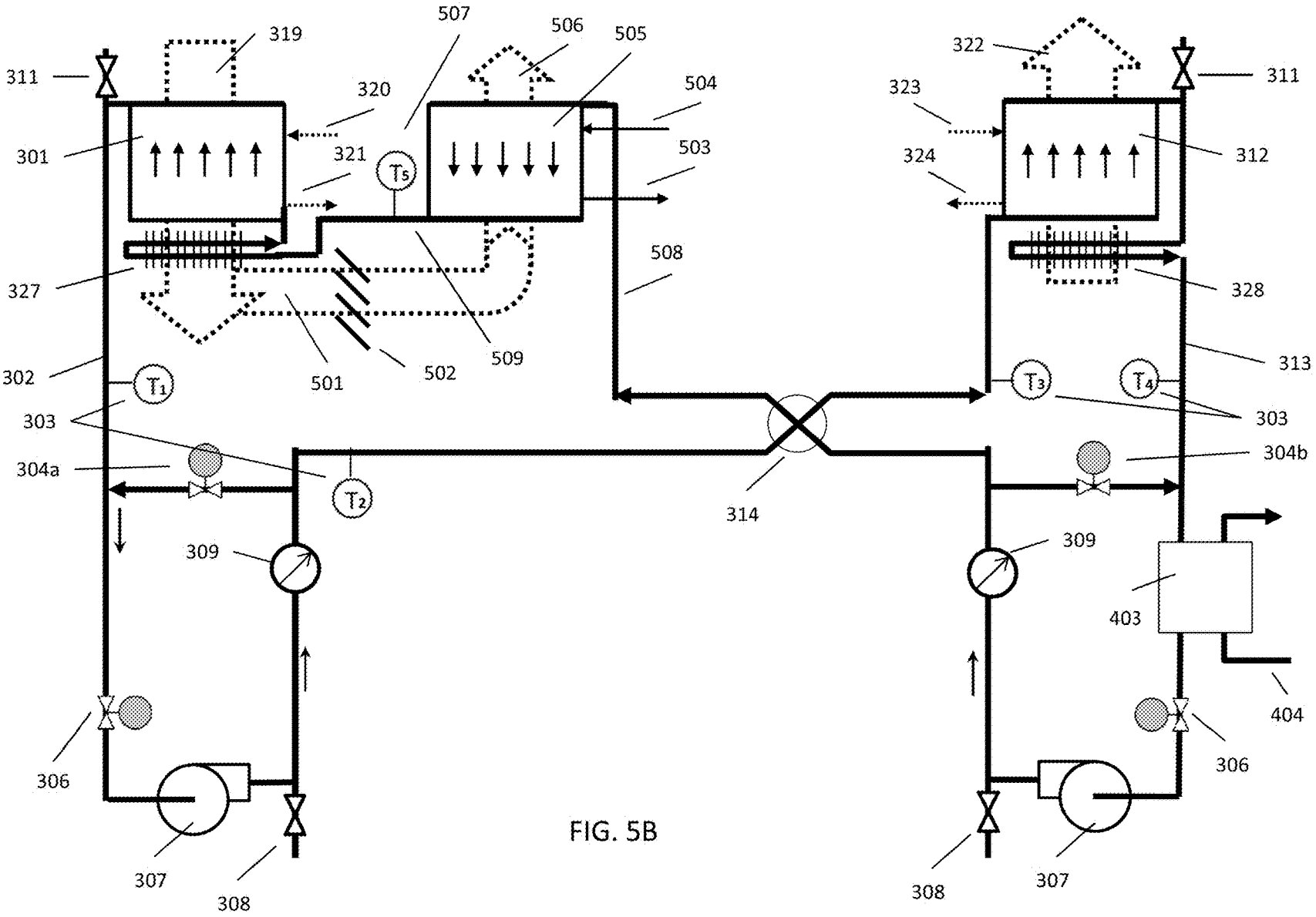
FIG. 5B illustrates the system of FIG. 5B wherein the system is set up as a sensible heat recovery system in accordance with one or more embodiments.

FIG. 5B illustrates the system from FIG. 5A in an energy recovery mode, with the diverter valve 314 set up to connect the fluid paths between the conditioner 301 and regenerator 313. As before this setup allows for recovery of heat from the return air 322 to be applied to the incoming air 319. In this situation it is also better to bypass the evaporator 505, although one could simply not supply water 504 to the evaporator module and also close louvers 502 so not air is diverted to the evaporator module.

Figure 5C:
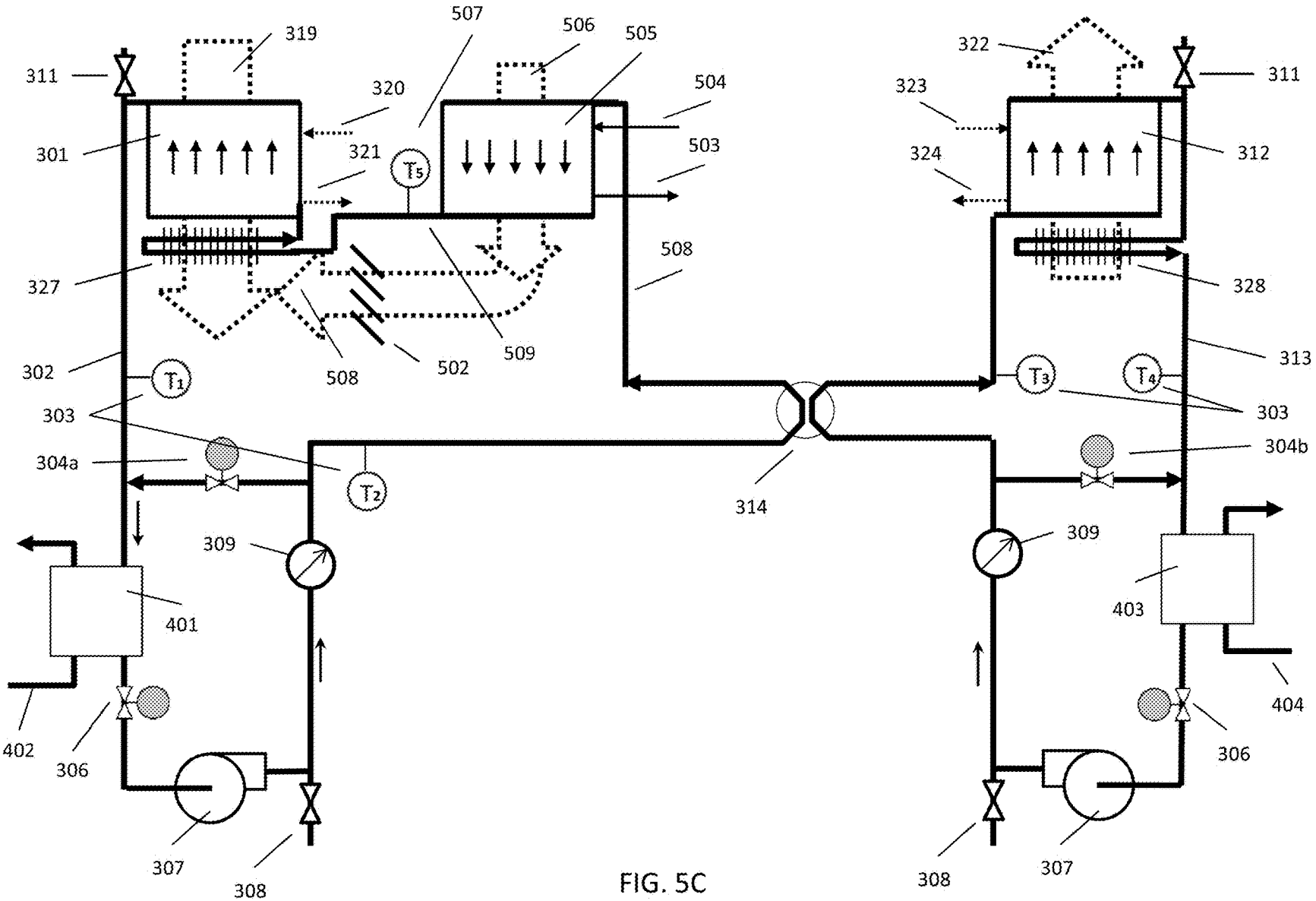
FIG. 5C shows the system of FIG. 5A wherein the system's operation is reversed for winter heating operation in accordance with one or more embodiments.

FIG. 5C now illustrates the system from FIG. 5A in a winter heating mode wherein the air flow 506 through the evaporator has been reversed so that it mixes with the air stream 319 from the conditioner. Also in this figure, the heat exchanger 401 and heat transfer fluid 402 are used to supply heat energy to the evaporator and conditioner modules. This heat can come from any convenient source such as a gas fired water heater, a waste heat source or a solar heat source. The advantage of this arrangement is that the system is now able to both heat (through the evaporator and the conditioner) and humidify (through the evaporator) the supply air. In this arrangement it is typically not advisable to supply liquid desiccant 320 to the conditioner module unless the liquid desiccant is able to pick up moisture from somewhere else, e.g., from the return air 322 or unless water is added to the liquid desiccant on a periodic basis. But even then, one has to carefully monitor the liquid desiccant to ensure that the liquid desiccant does not become overly concentrated.

Figure 6A:
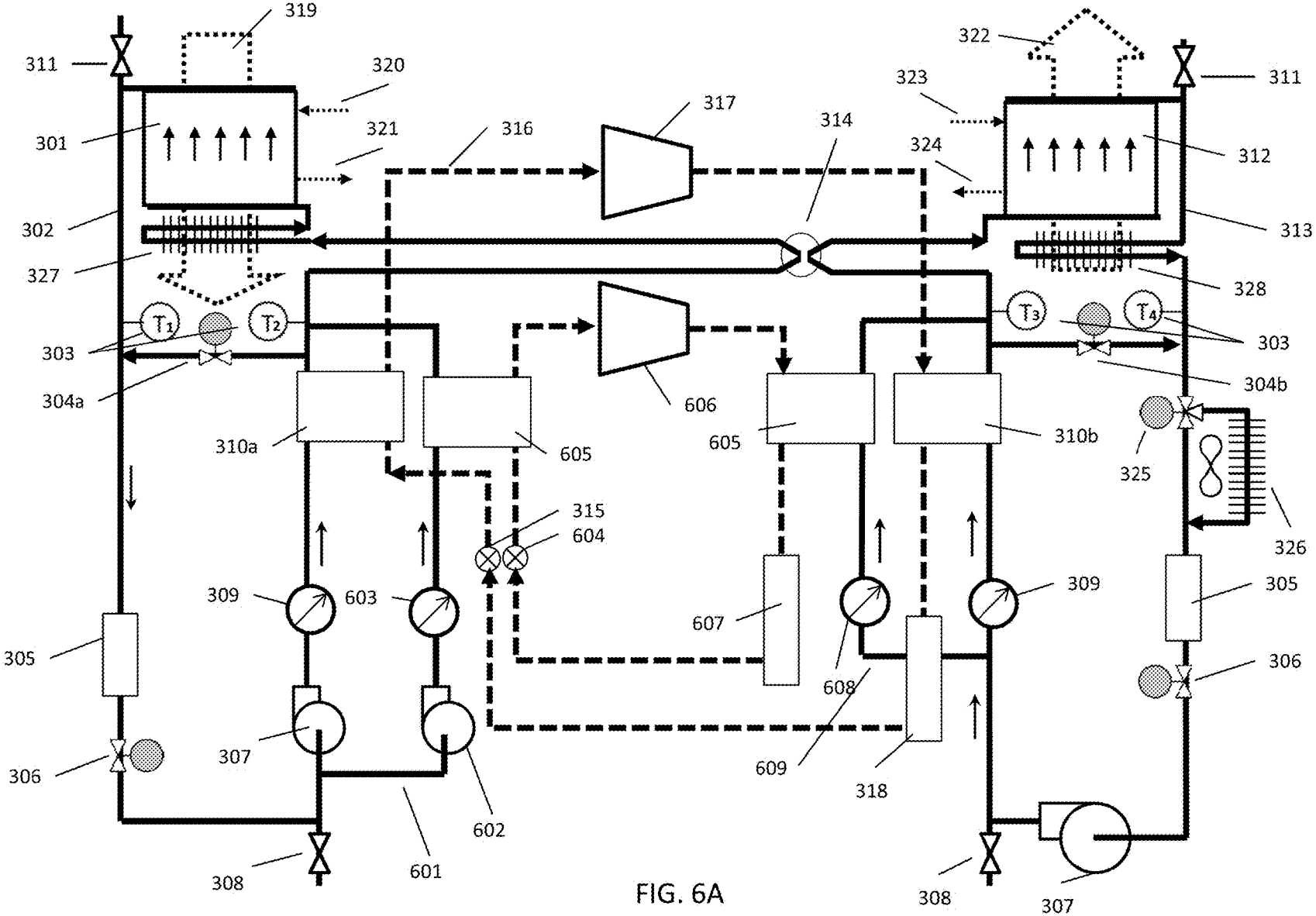
FIG. 6A illustrates the water and refrigerant control diagram of a dual compressor system employing several control loops for water flows and heat rejection in accordance with one or more embodiments.

FIG. 6A illustrates a system similar to that of FIG. 3A, wherein there are now two independent refrigerant circuits. An additional compressor heat pump 606 supplies refrigerant to a heat exchanger 605, after which it is received in a refrigerant receiver 607, expanded through a valve 610 and entered into another heat exchanger 604. The system also employs a secondary heat transfer fluid loop 601 by using fluid pump 602, flow measurement device 603 and the aforementioned heat exchanger 604. On the regenerator circuit a second heat transfer loop 609 is created and a further flow measurement instrument 608 is employed. It is worth noting that in the heat transfer loops on the conditioner side 2 circulating pumps 307 and 602 are used, whereas on the regenerator a single circulating pump 307 is used. This is for illustrative purposes only to show that many combinations of heat transfer flows and refrigerant flows could be employed.

Figure 6B:
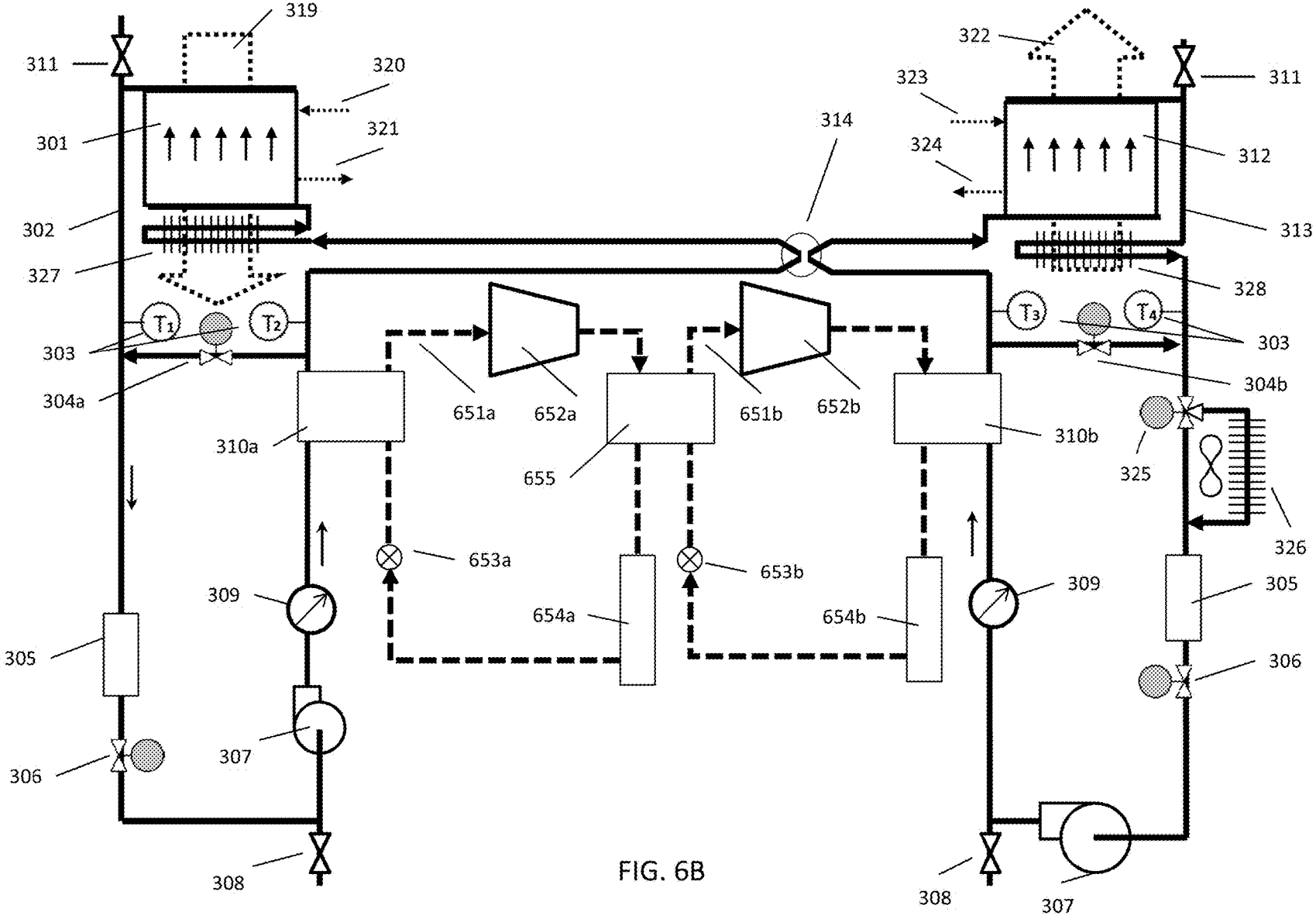
FIG. 6B shows a system employing two stacked refrigerant loops for more efficiently moving heat from the conditioner to the regenerator in accordance with one or more embodiments.

FIG. 6B shows a system similar to that of FIG. 3A where the single refrigerant loop is now replaced by two stacked refrigerant loops. In the figure heat exchanger 310*a* exchanges heat with the first refrigerant loop 651*a*. The first compressor 652*a* compresses the refrigerant that has been evaporated in the heat exchanger 310*a* and moves it to a condenser/heat exchanger 655, where the heat generated by the compressor is removed and the cooled refrigerant is received in the optional liquid receiver 654*a*. An expansion valve 653*a* expands the liquid refrigerant so it can absorb heat in the heat exchanger 310*a*. The second refrigerant loop 651*b* absorbs heat from the first refrigerant loop in the condenser/heat exchanger 655. The gaseous refrigerant is compressed by the second compressor 652*b* and heat is released in the heat exchanger 310*b*. The liquid refrigerant is then received in optional liquid receiver 654*b* and expanded by expansion valve 653*b* where it is returned to the heat exchanger 655.

Figure 7A:
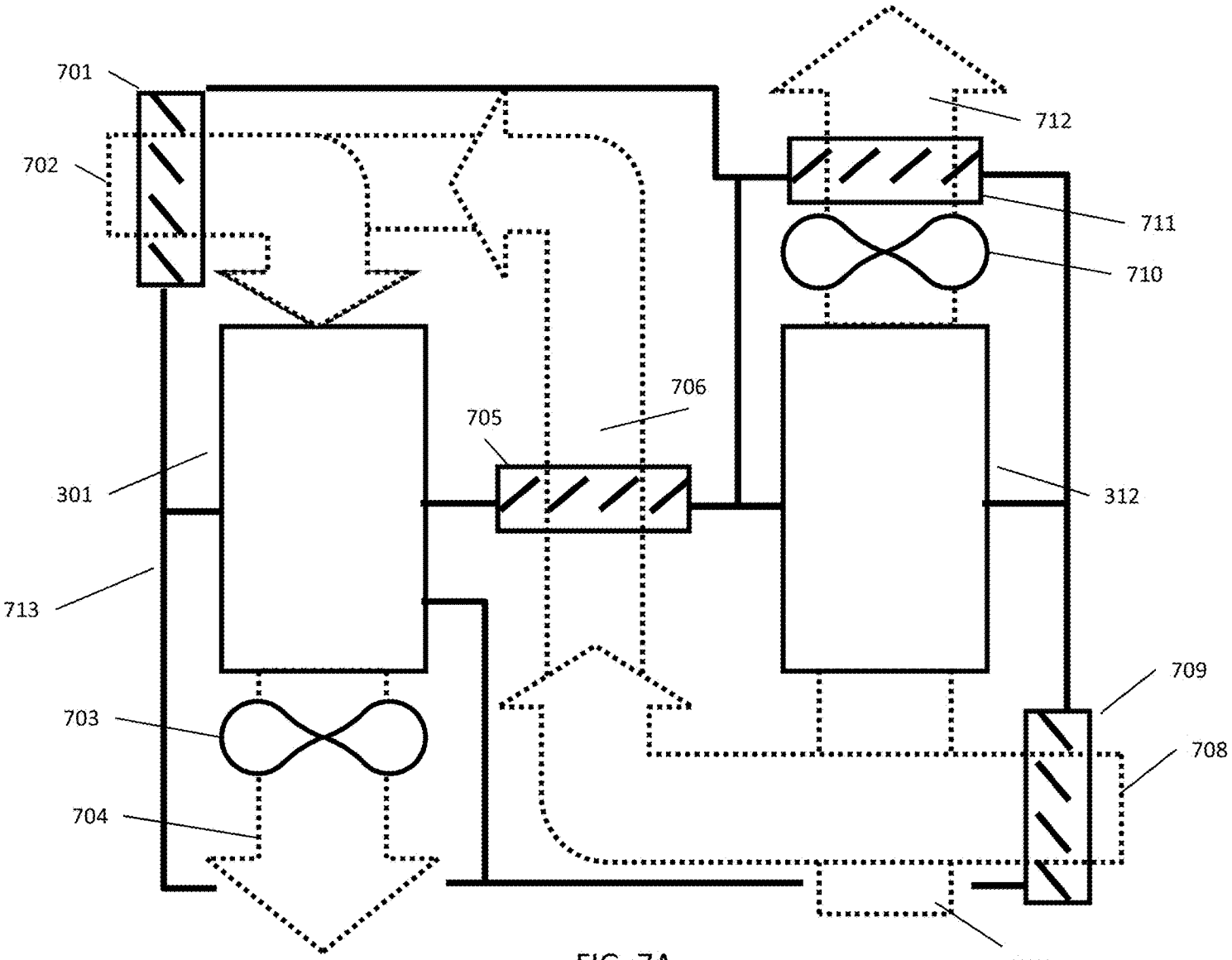
FIG. 7A shows an air flow diagram with a partial re-use of return air using a negative pressure housing compared to environmental pressure in accordance with one or more embodiments.

FIG. 7A illustrates a representative example of how air streams in a membrane liquid desiccant air conditioning system can be implemented. The membrane conditioner 301 and the membrane regenerator 312 are the same as those from FIG. 3A. Outside air 702 enters the system through an adjustable set of louvers 701. The air is optionally mixed internally to the system with a secondary air stream 706. The combined air stream enters the membrane module 301. The air stream is pulled through the membrane module 301 by fan 703 and is supplied to the space as a supply air stream 704. The secondary air stream 706 can be regulated by a second set of louvers 705. The secondary air stream 706 can be a combination of two air streams 707 and 708, wherein air stream 707 is a stream of air that is returned from the space to the air conditioning system and the air stream 708 is outside air that can be controlled by a third set of louvers 709. The air mixture consisting of streams 707 and 708 is also pulled through the regenerator 312 by the fan 710 and is exhausted through a fourth set of louvers 711 into an exhaust air stream 712. The advantage of the arrangement of FIG. 7A is that the entire system experiences a negative air pressure compared to the ambient air outside the system's housing—indicated by the boundary 713. The negative pressure is provided by the fans 703 and 710. Negative air pressure in the housing helps keep tight seals on door and access panels since the outside air helps maintain a force on those seals. However, the negative air pressure also has a disadvantage in that it can inhibit the siphoning of the desiccant in the membrane panel (FIG. 2A) and can even lead to the thin membranes being pulled into the air gaps (FIG. 2B).

Figure 7B:
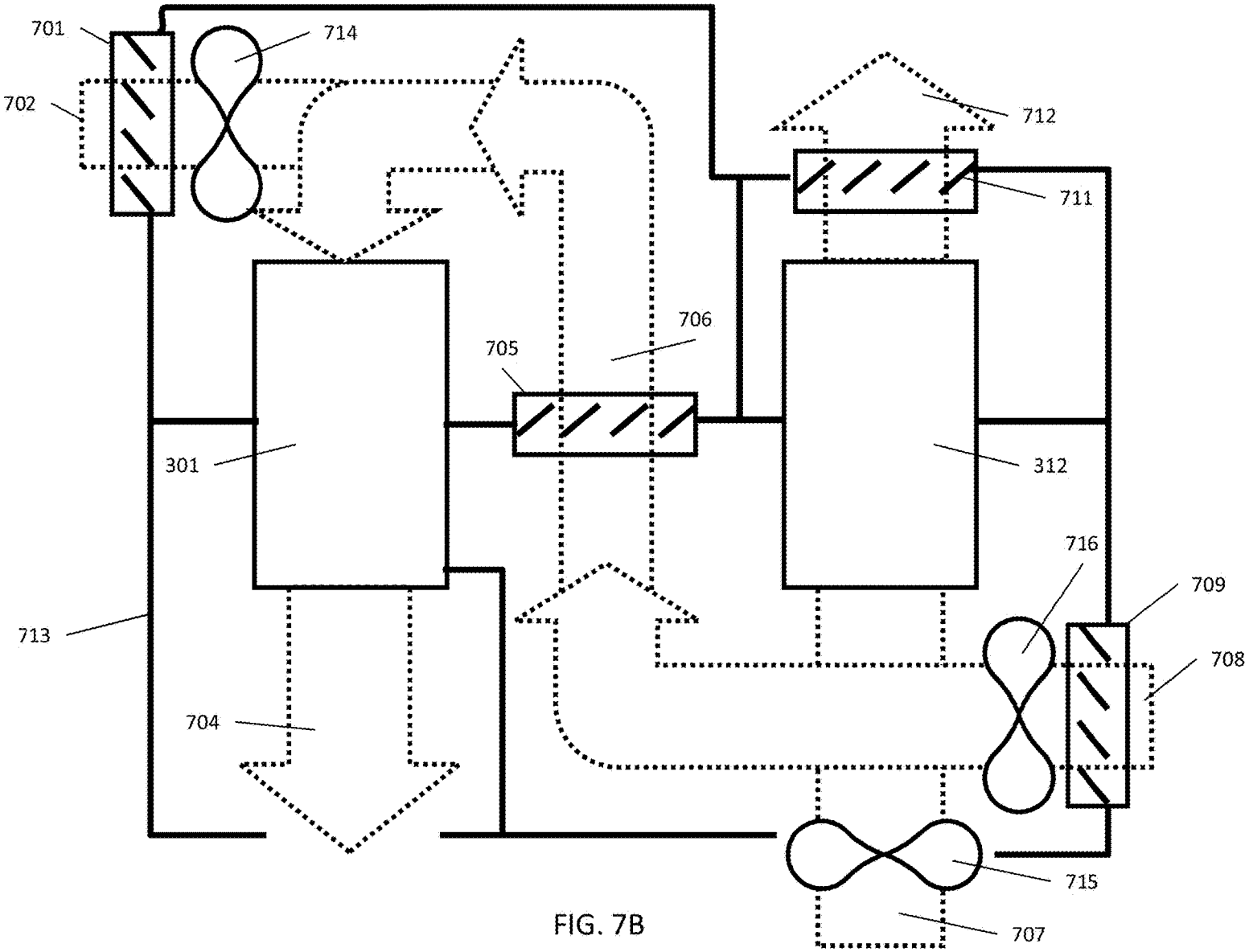
FIG. 7B shows an air flow diagram with a partial re-use of return air using a positive pressure housing compared to environmental pressure in accordance with one or more embodiments.

FIG. 7B illustrates an alternate embodiment of an arrangement where fans have been placed in such a way as to create a positive internal pressure. A fan 714 is used to provide positive pressure above the conditioner module 301. Again the air stream 702 is mixed with the air stream 706 and the combined air stream enters the conditioner 301. The conditioned air stream 704 is now supplied to the space. A return air fan 715 is used to bring return air 707 back from the space and a second fan 716 is needed to provide additional outside air. There is a need for this fan because in many situations the amount of available return air is much less than the amount of air supplied to the space so additional air has to be provided to the regenerator. The arrangement of FIG. 7B therefore necessitates the use of 3 fans and 4 louvers.

Figure 7C:
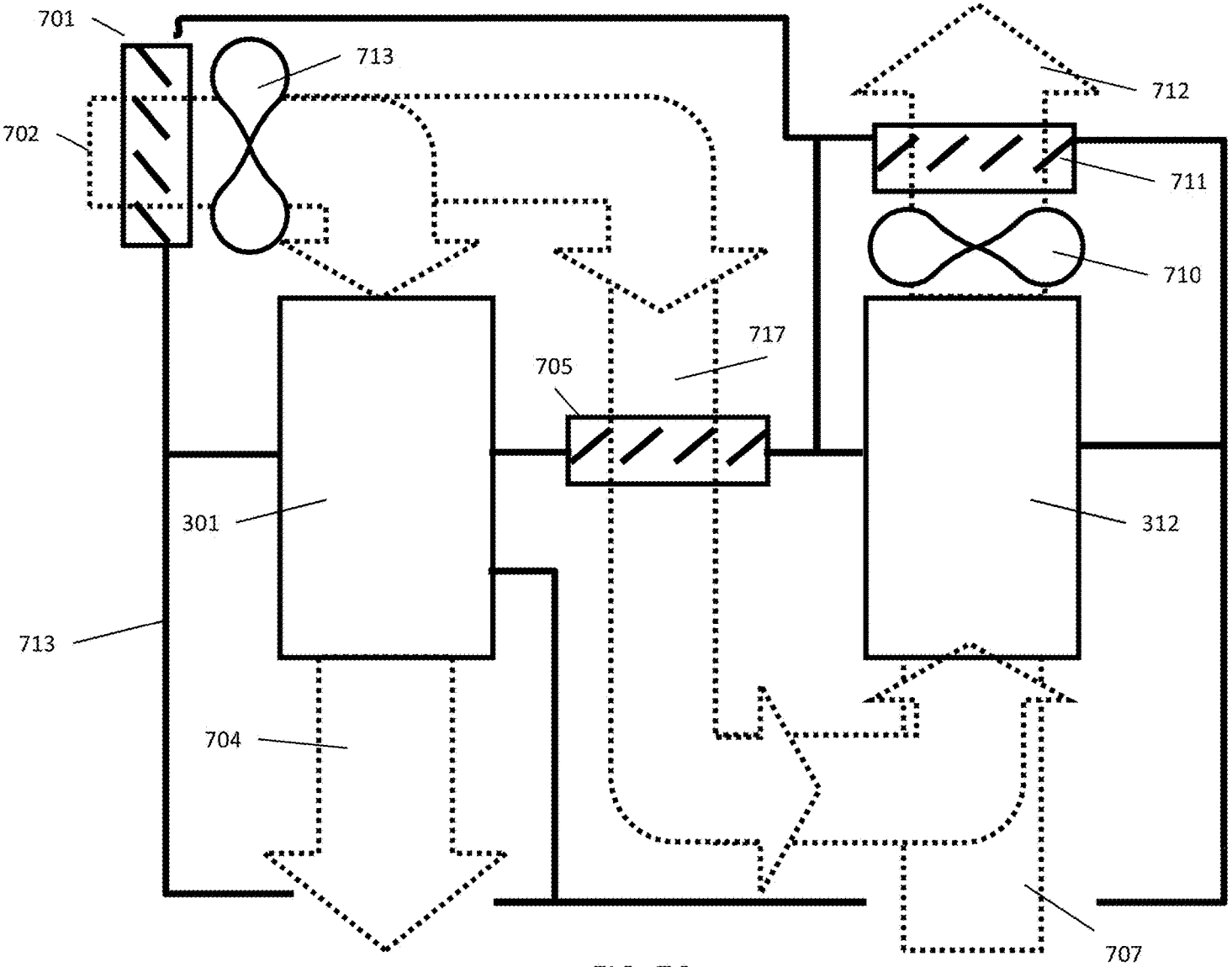
FIG. 7C shows an air flow diagram with a partial re-use of return air and a positive pressure supply air stream and a negative pressure return air stream wherein a portion of the outdoor air is used to increase flow through the regeneration module in accordance with one or more embodiments.

FIG. 7C shows a hybrid embodiment wherein the conditioner is using a positive pressure similar to FIG. 7A but wherein the regenerator is under negative pressure similar to FIG. 7B. The main difference is that the air stream 717 is now reversed in direction compared to the mixed air stream 706 in FIGS. 7A and 7B. This allows a single fan 713 to supply outside air to both the conditioner 301 and the regenerator 312. The return air stream 707 is now mixed with the outside air stream 717 so that ample air is supplied to the regenerator. The fan 710 is pulling air through the regenerator 312 resulting in a slightly negative pressure in the regenerator. The advantage of this embodiment is that the system only requires 2 fans and 2 sets of louvers. A slight disadvantage is that the regenerator experiences negative pressures and is thus less able to siphon and has a higher risk of the membrane being pulled into the air gap.

Figure 8A:
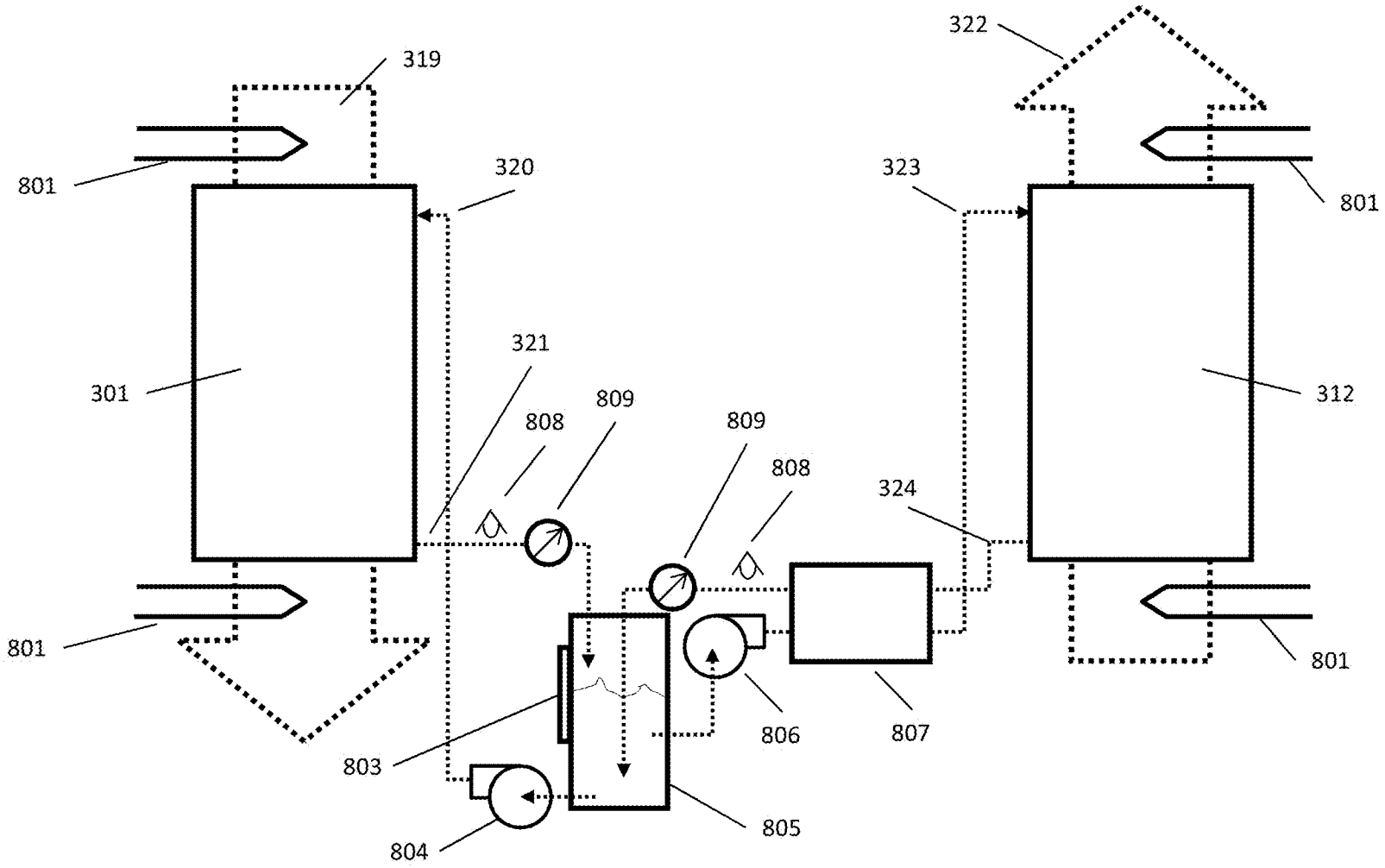
FIG. 8A illustrates a single tank control diagram for a desiccant flow in accordance with one or more embodiments.

FIG. 8A shows the schematic of the liquid desiccant flow circuit. Air enthalpy sensors 801 employed before and after the conditioner and regenerator modules give a simultaneous measurement of air temperature and humidity. The before and after enthalpy measurements can be used to indirectly determine the concentration of the liquid desiccant. A lower exiting humidity indicates a higher desiccant concentration. The liquid desiccant is taken from a reservoir 805 by pump 804 at an appropriately low level because the desiccant will stratify in the reservoir. Typically the desiccant will be about 3-4% less concentrated near the top of the reservoir compared to the bottom of the reservoir. The pump 804 brings the desiccant to the supply port 320 near the top of the conditioners. The desiccant flows behind the membranes and exits the module through port 321. The desiccant is then pulled by a siphoning force into the reservoir 805 while passing a sensor 808 and a flow sensor 809. The sensor 808 can be used to determine the amount of air bubbles that are formed in the liquid desiccant going through the drain port 321. This sensor can be used to determine if the membrane properties are changing: the membrane lets a small amount of air through as well as water vapor. This air forms bubbles in the exit liquid desiccant stream. A change in membrane pore size for example due to degradation of the membrane material will lead to an increase in bubble frequency and bubble sizes all other conditions being equal. The sensor 808 can thus be used to predict membrane failure or degradation well before a catastrophic failure happens. The flow sensor 809 is used to ensure that the proper amount of desiccant is returning to the reservoir 805. A failure in the membrane module would result in little or no desiccant returning and thus the system can be stopped. It would also be possible to integrate the sensors 808 and 809 into a single sensor embodying both functions or, e.g., for sensor 808 to register that no more air bubbles are passing as an indication of stopped flow.

Again in FIG. 8A, a second pump 806 pulls dilute liquid desiccant at a higher level from the reservoir. The diluted desiccant will be higher in the reservoir since the desiccant will stratify if one is careful not to disturb the desiccant too much. The dilute desiccant is then pumped through a heat exchanger 807 to the top of the regenerator module supply port 323. The regenerator re-concentrates the desiccant and it exits the regenerator at port 324. The concentrated desiccant then passes the other side of the heat exchanger 807, and passes a set of sensors 808 and 809 similar to those used on the conditioner exit. The desiccant is then brought back to the reservoir into the stratified desiccant at a level approximately equal to the concentration of the desiccant exiting the regenerator.

The reservoir 805 is also equipped with a level sensor 803. The level sensor can be used to determine the level of desiccant in the reservoir but is also an indication of the average concentration desiccant in the reservoir. Since the system is charged with a fixed amount of desiccant and the desiccant only absorbs and desorbs water vapor, the level can be used to determine the average concentration in the reservoir.

Figure 8B:
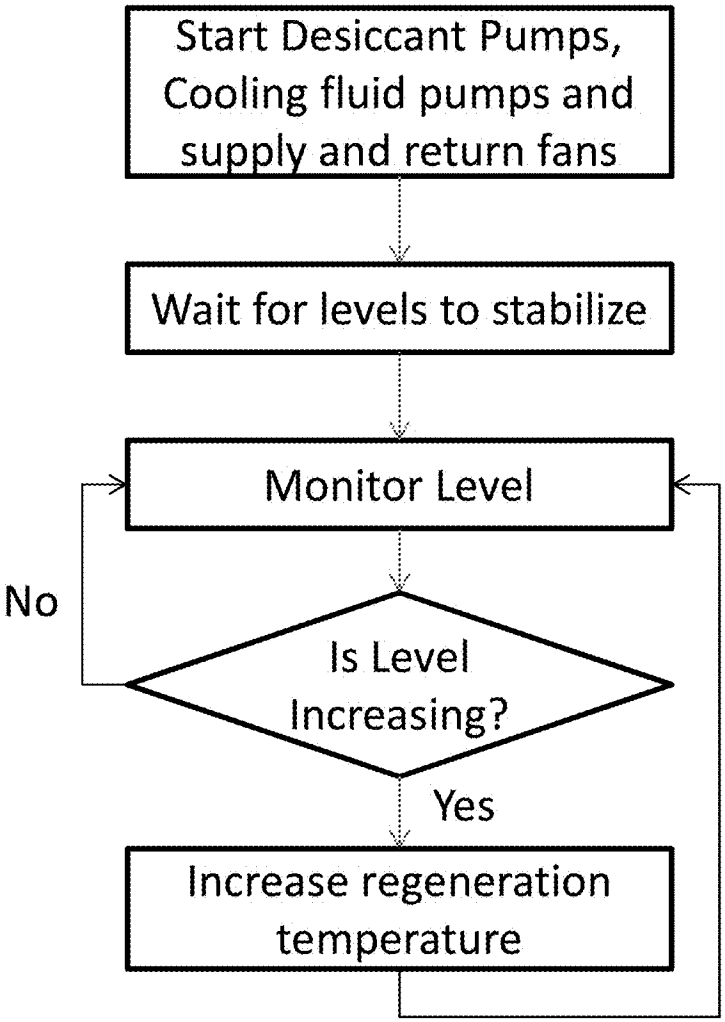
FIG. 8B shows a simple decision schematic for controlling the liquid desiccant level in the system in accordance with one or more embodiments.

FIG. 8B illustrates a simple decision tree for monitoring the desiccant level in a liquid desiccant system. The control system starts the desiccant pumps and waits a few minutes for the system to reach a stable state. If after the initial startup period the desiccant level is rising (which indicates that more water vapor is removed from the air then is removed in the regenerator then the system can correct by increasing the regeneration temperature, for example by closing the bypass valve 304*b* in FIG. 3A or by closing the bypass loop valve 325 also in FIG. 3A.

Figure 9A:
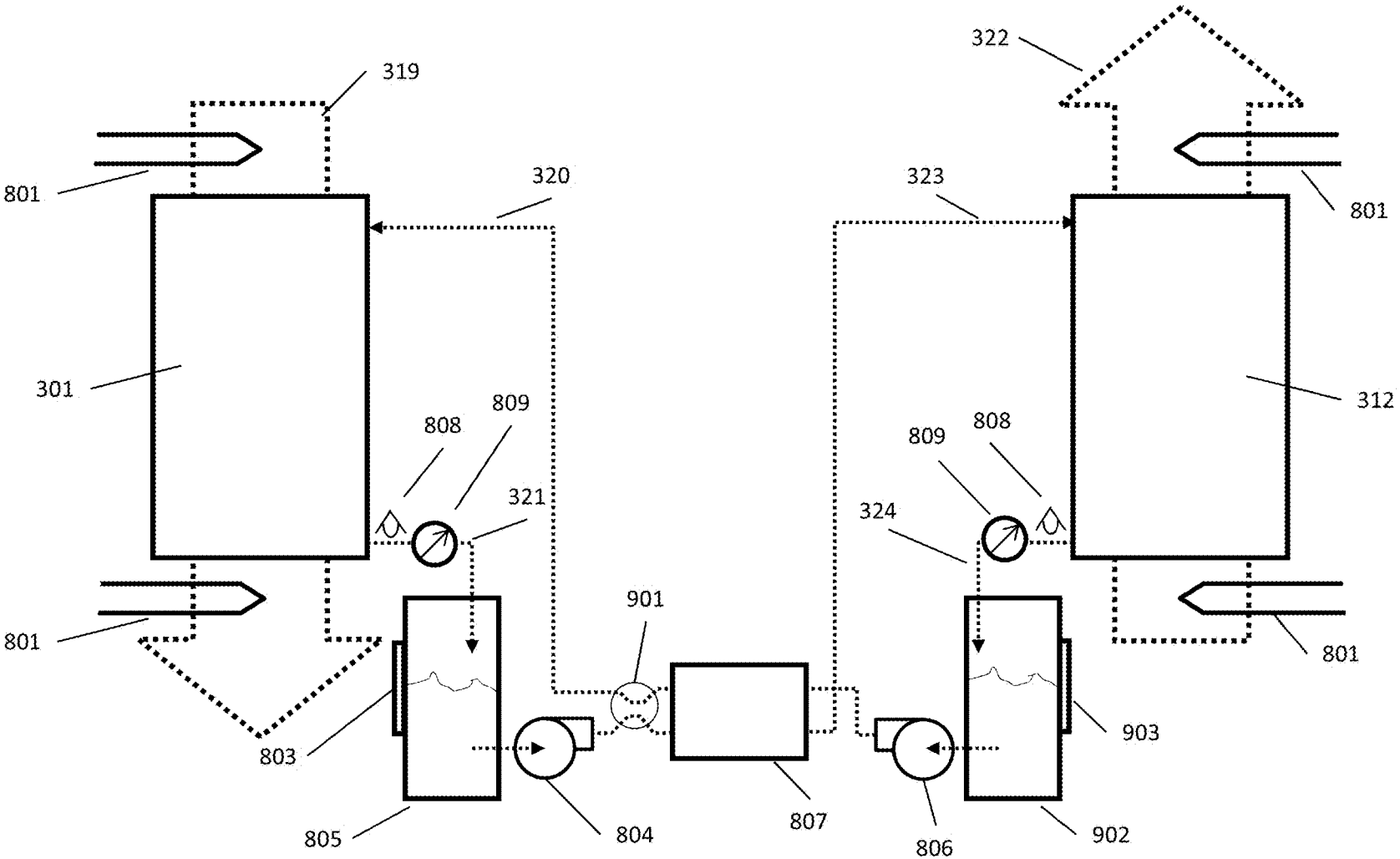
FIG. 9A shows a dual tank control diagram for a desiccant flow, wherein a portion of the desiccant is sent from a conditioner to a regenerator in accordance with one or more embodiments.

FIG. 9A shows a liquid desiccant control system wherein two reservoirs 805 and 902 are employed. The addition of the second reservoir 902 can be necessary if the conditioner and regenerator air not in near proximity to each other. Since the desiccant siphoning is desirable having a reservoir near or underneath the conditioner and regenerator is sometimes a necessity. A 4-way valve 901 can also added to the system. The addition of a 4-way valve allows the liquid desiccant to be sent from the conditioner reservoir 805 to the regenerator module 312. The liquid desiccant is now able to pick up water vapor from the return air stream 322. The regenerator is not heated by the heat transfer fluid in this operating mode. The diluted liquid desiccant is now directed back through the heat exchanger 807 and to the conditioner module 301. The conditioner module is not being cooled by the heat transfer fluid. It is actually possible to heat the conditioner module and cool the regenerator which makes them function opposite from their normal operation. In this fashion it is possible to add heat and humidity to the outside air 319 and recover heat and humidity from the return air. It is worthwhile noting that if one wants to recover heat as well as humidity, the heat exchanger 807 can be bypassed. The second reservoir 902 has a second level sensor 903. The monitoring schematic of FIG. 8B can still be employed by simply adding the two level signals together and using the combined level as the level to be monitored.

Figure 9B:
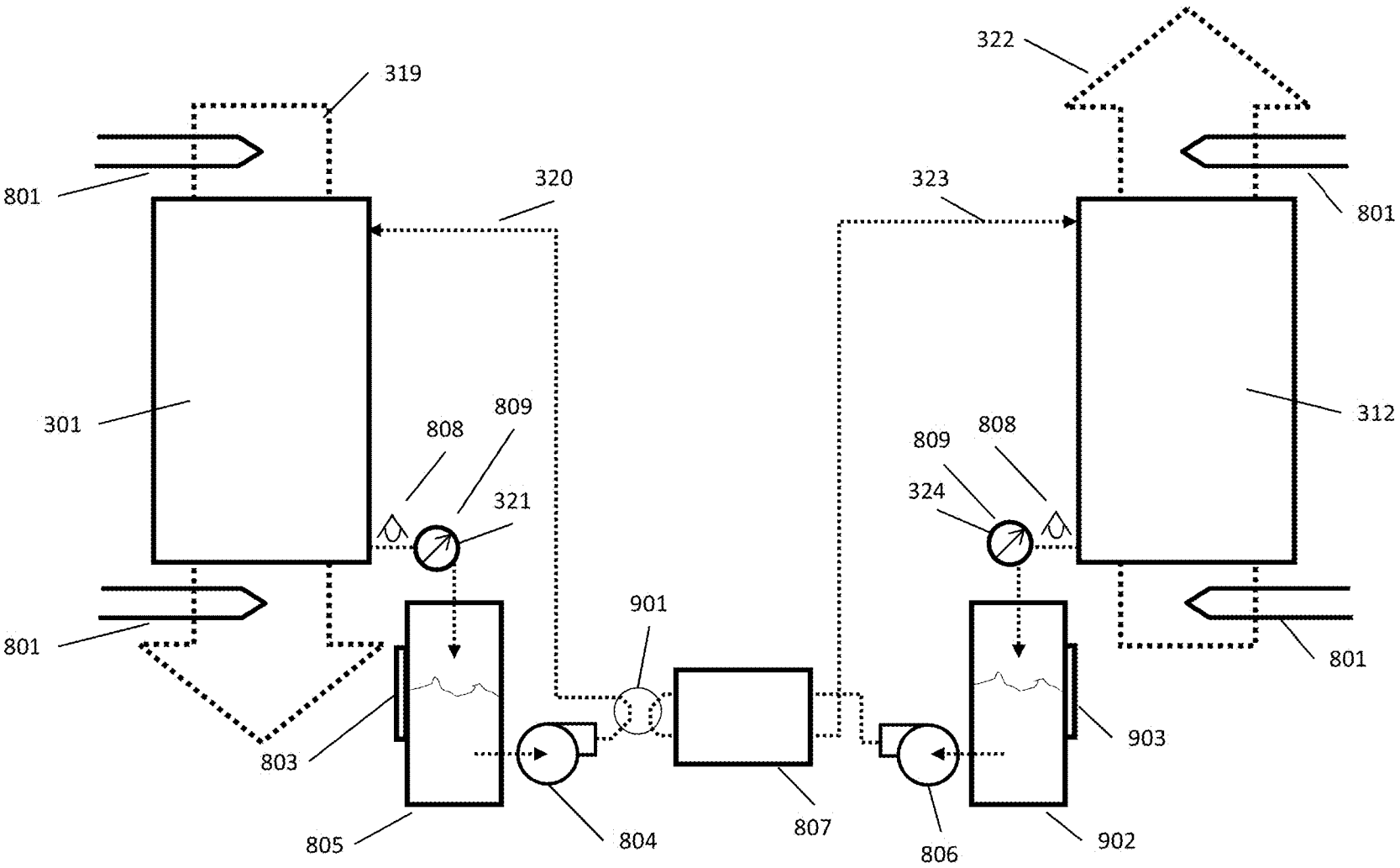
FIG. 9B shows the system of FIG. 9A wherein the desiccant is used in an isolation mode for conditioner and regenerator in accordance with one or more embodiments.

FIG. 9B illustrates the flow diagram of the liquid desiccants if the 4-way valve 901 is set to an isolated position. In this situation no desiccant is moved between the two sides and each side is independent of the other side. This operating mode can be useful if very little dehumidification needs to be obtained in the conditioner. The regenerator could effectively be idled in that case.

Figure 10B:
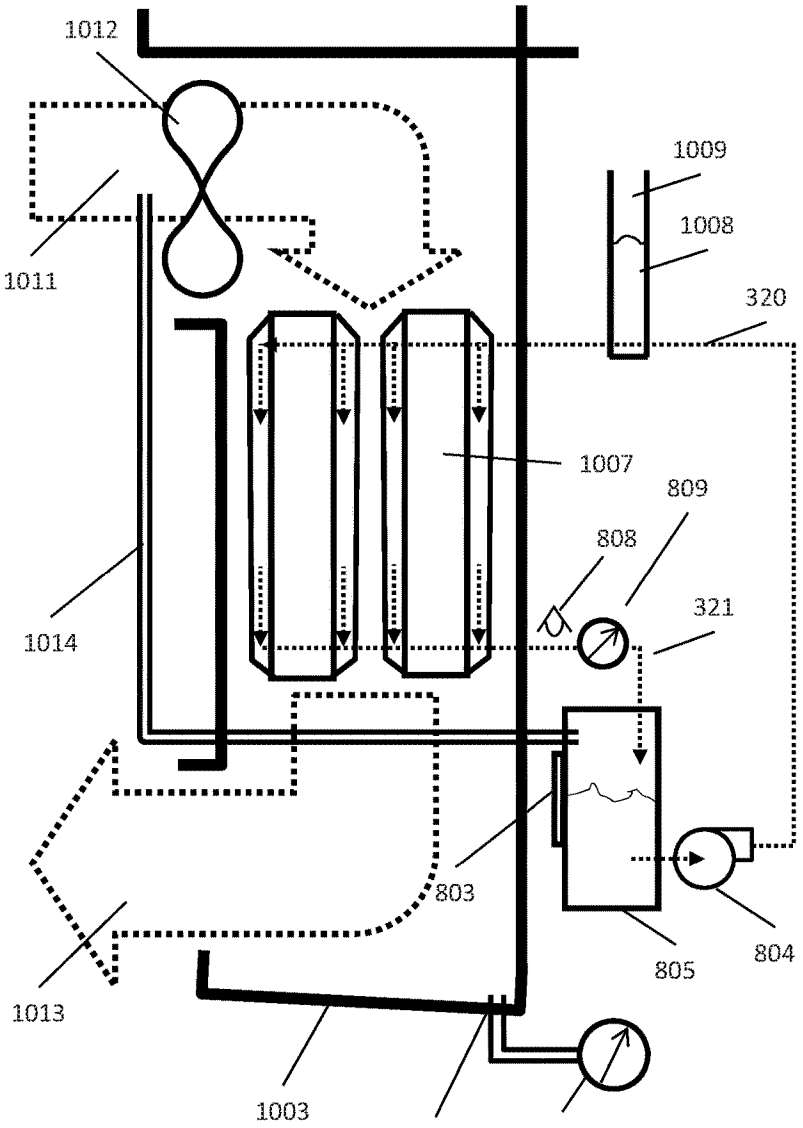
FIG. 10B shows the system of FIG. 10A with a positive air pressure liquid desiccant system in accordance with one or more embodiments.
Figure 10A:
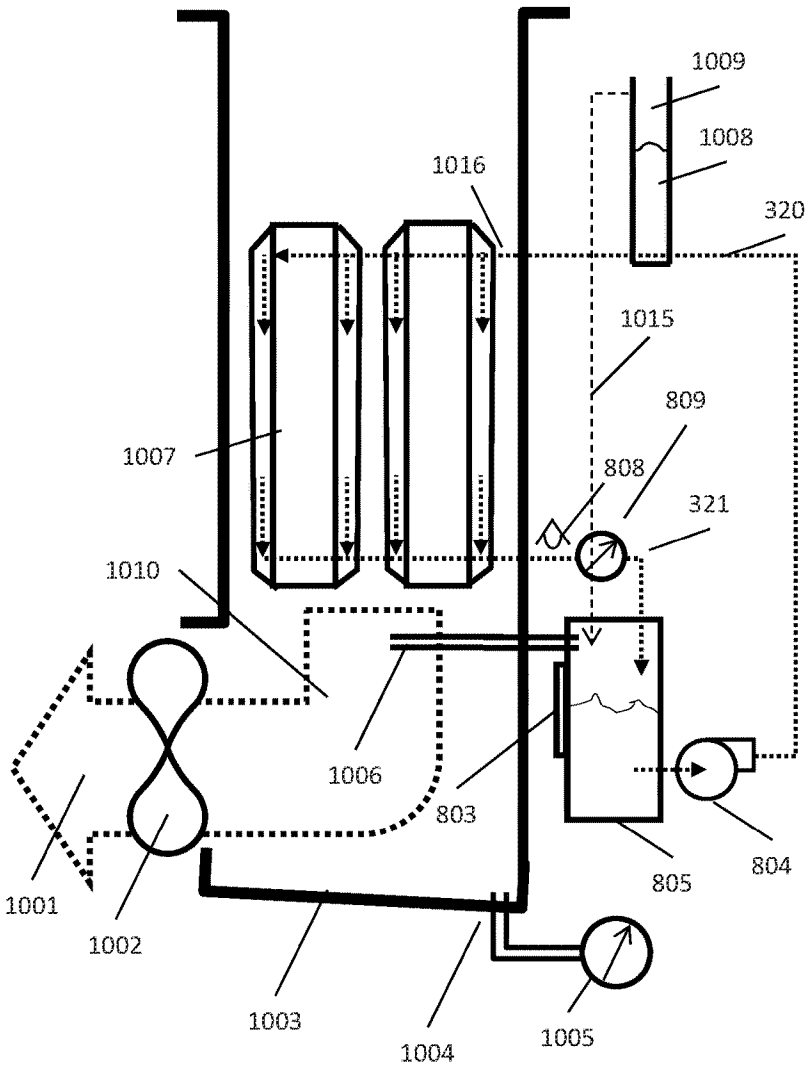
FIG. 10A illustrates the flow diagram of a negative air pressure liquid desiccant system with a desiccant spill sensor in accordance with one or more embodiments.

FIG. 10A illustrates a set of membrane plates 1007 mounted in a housing 1003. The supply air 1001 is pulled through the membrane plates 1007 by the fan 1002. This arrangement results in a negative pressure around the membrane plates compared to the ambient outside the housing 1003 as was discussed earlier. In order to maintain a proper pressure balance above the liquid desiccant reservoir 805, a small tube or hose 1006 is connecting the low pressure area 1010 to the top of the reservoir 805. Furthermore, a small, vertical hose 1009 is employed near the top port 1016 of the membrane module wherein a small amount of desiccant 1008 is present. The desiccant level 1008 can be maintained at an even height resulting in a controlled supply of desiccant to the membrane plates 1007. An overflow tube 1015 ensures that if the level of desiccant in the vertical hose 1009 rises too high—and thus too much desiccant pressure is applied on the membranes—excess desiccant is drained back to the reservoir 805, thereby bypassing the membrane plates 1007 and thereby avoiding potential membrane damage.

Again referring to FIG. 10A, the bottom of the housing 1003 is slightly sloped towards a corner 1004 wherein a conductivity sensor 1005 is mounted. The conductivity sensor can detect any amount of liquid that may have fallen from the membrane plates 1007 and is thus able to detect any problems or leaks in the membrane plates.

FIG. 10B shows a system similar to that of 10A except that the fan 1012 is now located on the opposite side of the membrane plates 1007. The air stream 1013 is now pushed through the plates 1007 resulting in a positive pressure in the housing 1003. A small tube or hose 1014 is now used to connect the low pressure area 1011 to the air at the top of the reservoir 805. The connection between the low pressure point and the reservoir allows for the largest pressure difference between the liquid desiccant behind the membrane and the air, resulting in good siphoning performance. Although not shown, an overflow tube similar to tube 1015 in FIG. 10A can be provided to ensure that if the level of desiccant in the overflow tube rises too high—and thus too much desiccant pressure is applied on the membranes—excess desiccant is drained back to the reservoir 805, thereby bypassing the membrane plates 1007 and thereby avoiding potential membrane damage. Having thus described several illustrative embodiments, it is to be appreciated that various alterations, modifications, and improvements will readily occur to those skilled in the art. Such alterations, modifications, and improvements are intended to form a part of this disclosure, and are intended to be within the spirit and scope of this disclosure. While some examples presented herein involve specific combinations of functions or structural elements, it should be understood that those functions and elements may be combined in other ways according to the present disclosure to accomplish the same or different objectives. In particular, acts, elements, and features discussed in connection with one embodiment are not intended to be excluded from similar or other roles in other embodiments. Additionally, elements and components described herein may be further divided into additional components or joined together to form fewer components for performing the same functions. Accordingly, the foregoing description and attached drawings are by way of example only, and are not intended to be limiting.

What is claimed is:

1. A desiccant air conditioning system for treating an air stream entering a building space, the desiccant air conditioning system being switchable between operating in a warm weather operation mode and in a cold weather operation mode, comprising:

a conditioner configured to expose the air stream to a liquid desiccant such that the liquid desiccant dehumidifies the air stream in the warm weather operation mode and humidifies the air stream in the cold weather operation mode, the conditioner including a plurality of plate structures arranged in a parallel orientation and spaced apart to permit the air stream to flow between the plate structures, each plate structure including a passage through which a heat transfer fluid flows, each plate structure also having at least one surface across which the liquid desiccant flows, each plate structure further comprising a membrane positioned proximate the at least one surface of the plate structure between the liquid desiccant and the air stream;

a fan positioned at the conditioner for moving the air stream through the conditioner;

a regenerator connected to the conditioner for receiving the liquid desiccant from the conditioner, said regenerator causing the liquid desiccant to desorb water in the warm weather operation mode and to absorb water in the cold weather operation mode from a return air stream;

a liquid desiccant loop for circulating the liquid desiccant between the conditioner and the regenerator;

a reservoir coupled to the liquid desiccant loop for collecting liquid desiccant flowing from the conditioner;

a vertical tube proximate a desiccant entry port at one of the plate structures in the conditioner, said vertical tube being coupled to the liquid desiccant loop to detect flow of liquid desiccant to the conditioner based on a height of the liquid desiccant in the vertical tube;

an overflow tube coupling an upper end of the vertical tube to the reservoir to inhibit application of excessive pressure by the liquid desiccant on the membranes in the conditioner;

a heat source or cold source system for transferring heat to the heat transfer fluid used in the conditioner in the cold weather operation mode, for receiving heat from the heat transfer fluid used in the conditioner in the warm weather operation mode, for transferring heat to the heat transfer fluid used in the regenerator in the warm weather operation mode, or for receiving heat from the heat transfer fluid used in the regenerator in the cold weather operation mode;

a conditioner heat transfer fluid loop for circulating heat transfer fluid through the conditioner and exchanging heat with the heat source or cold source system; and a regenerator heat transfer fluid loop for circulating heat transfer fluid through the regenerator and exchanging heat with the heat source or cold source system.

2. The system of claim 1, wherein the conditioner further comprises a sloped surface beneath the plurality of plate structures and a conductivity sensor mounted at a low point on the sloped surface to detect any liquid desiccant fallen from the plurality of plate structures.

3. The method of claim 1, wherein the fan is positioned at an outlet of the conditioner for applying negative pressure to the conditioner to draw the air stream through the conditioner.

4. The system of claim 3, further comprising a tube connecting a low pressure area in the outlet of the conditioner to an upper portion of the reservoir to maintain a pressure balance above the liquid desiccant in the reservoir.

5. The method of claim 1, wherein the plurality of plate structures are arranged in a vertical orientation.

6. The method of claim 5, wherein the conditioner further comprises a sloped surface beneath the plurality of plate structures and a conductivity sensor mounted at a low point on the sloped surface to detect any liquid desiccant fallen from the plurality of plate structures.

7. The method of claim 1, wherein the fan is positioned at an inlet of the conditioner for applying positive pressure to the conditioner to push the air stream through the conditioner.

8. The system of claim 7, further comprising a tube connecting a low pressure area in the inlet of the conditioner to an upper portion of the reservoir to maintain a pressure balance above the liquid desiccant in the reservoir.

9. The system of claim 7, wherein the conditioner further comprises a sloped surface beneath the plurality of plate structures and a conductivity sensor mounted at a low point on the sloped surface to detect any liquid desiccant fallen from the plurality of plate structures.

10. A desiccant air conditioning system for treating an air stream entering a building space, the desiccant air conditioning system being operable in a warm weather operation mode and/or in a cold weather operation mode, comprising:

a conditioner configured to expose the air stream to a liquid desiccant such that the liquid desiccant dehumidifies the air stream in the warm weather operation mode and humidifies the air stream in the cold weather operation mode, the conditioner including a plurality of plate structures arranged in a parallel orientation and spaced apart to permit the air stream to flow between the plate structures, each plate structure including a passage through which a heat transfer fluid flows, each plate structure also having at least one surface across which the liquid desiccant flows, each plate structure further comprising a membrane positioned proximate the at least one surface of the plate structure between the liquid desiccant and the air stream;

a fan positioned at the conditioner for moving the air stream through the conditioner;

a regenerator connected to the conditioner for receiving the liquid desiccant from the conditioner, said regenerator causing the liquid desiccant to desorb water in the warm weather operation mode and to absorb water in the cold weather operation mode from a return air stream;

a liquid desiccant loop for circulating the liquid desiccant between the conditioner and the regenerator;

a reservoir coupled to the liquid desiccant loop for collecting liquid desiccant flowing from the conditioner;

a vertical tube proximate a desiccant entry port at one of the plate structures in the conditioner, said vertical tube being coupled to the liquid desiccant loop to detect flow of liquid desiccant to the conditioner based on a height of the liquid desiccant in the vertical tube;

an overflow tube coupling an upper end of the vertical tube to the reservoir to inhibit application of excessive pressure by the liquid desiccant on the membranes in the conditioner;

a heat source or cold source system for transferring heat to the heat transfer fluid used in the conditioner in the cold weather operation mode, for receiving heat from the heat transfer fluid used in the conditioner in the warm weather operation mode, for transferring heat to the heat transfer fluid used in the regenerator in the warm weather operation mode, or for receiving heat from the heat transfer fluid used in the regenerator in the cold weather operation mode;

a conditioner heat transfer fluid loop for circulating heat transfer fluid through the conditioner and exchanging heat with the heat source or cold source system; and a regenerator heat transfer fluid loop for circulating heat transfer fluid through the regenerator and exchanging heat with the heat source or cold source system.

11. The method of claim 10, wherein the fan is positioned at an outlet of the conditioner for applying negative pressure to the conditioner to draw the air stream through the conditioner.

12. The system of claim 11, further comprising a tube connecting a low pressure area in the outlet of the conditioner to an upper portion of the reservoir to maintain a pressure balance above the liquid desiccant in the reservoir.

13. The method of claim 10, wherein the plurality of plate structures are arranged in a vertical orientation.

14. The system of claim 13, wherein the conditioner further comprises a sloped surface beneath the plurality of plate structures and a conductivity sensor mounted at a low point on the sloped surface to detect any liquid desiccant fallen from the plurality of plate structures.

15. The method of claim 10, wherein the fan is positioned at an inlet of the conditioner for applying positive pressure to the conditioner to push the air stream through the conditioner.

16. The system of claim 15, further comprising a tube connecting a low pressure area in the inlet of the conditioner to an upper portion of the reservoir to maintain a pressure balance above the liquid desiccant in the reservoir.

17. The system of claim 15, wherein the conditioner further comprises a sloped surface beneath the plurality of plate structures and a conductivity sensor mounted at a low point on the sloped surface to detect any liquid desiccant fallen from the plurality of plate structures.

* * * * *